United States Patent [19]

Ballarini

[11] Patent Number: 4,585,272

[45] Date of Patent: Apr. 29, 1986

[54] CHAIR HAVING A BACK COMPRISING A PLURALITY OF ARTICULATED SEGMENTS

[75] Inventor: Luciano Ballarini, Bologna, Italy

[73] Assignee: Castelli S.p.A., Bologna, Italy

[21] Appl. No.: 544,896

[22] Filed: Oct. 24, 1983

[30] Foreign Application Priority Data

Oct. 22, 1982 [IT] Italy ..... 68229 A/82
Jul. 28, 1983 [IT] Italy ..... 67817 A/83

[51] Int. Cl.[4] ..... A47C 7/14

[52] U.S. Cl. ..... 297/284; 297/296; 297/300

[58] Field of Search ..... 297/284, 300, 285, 296, 297/297, 298

[56] References Cited

U.S. PATENT DOCUMENTS 35,761 7/1862 Judah ..... 297/296 X
462,655 11/1891 Daniel ..... 297/297
3,565,482 2/1971 Blodee ..... 297/284
3,877,750 4/1975 Scholpp ..... 297/284
4,157,203 6/1979 Ambasz ..... 297/300

FOREIGN PATENT DOCUMENTS 2619538 11/1977 Fed. Rep. of Germany ..... 297/296
140901 4/1920 United Kingdom ..... 297/297

*Primary Examiner*—Francis K. Zugel
*Attorney, Agent, or Firm*—Sughrue, Mion, Zinn, Macpeak & Seas

[57] ABSTRACT

A chair has a reclinable backrest formed by a series of at least three superimposed segments articulated together about respective substantially horizontal axes to define, in the reclined position of the backrest, an arcuate configuration with a curve substantially corresponding to that of the arched back of a user. Resilient means are provided for resisting the movement of the segments towards the position corresponding to the reclined position of the backrest.

44 Claims, 51 Drawing Figures

Figures 1, 2, 3:
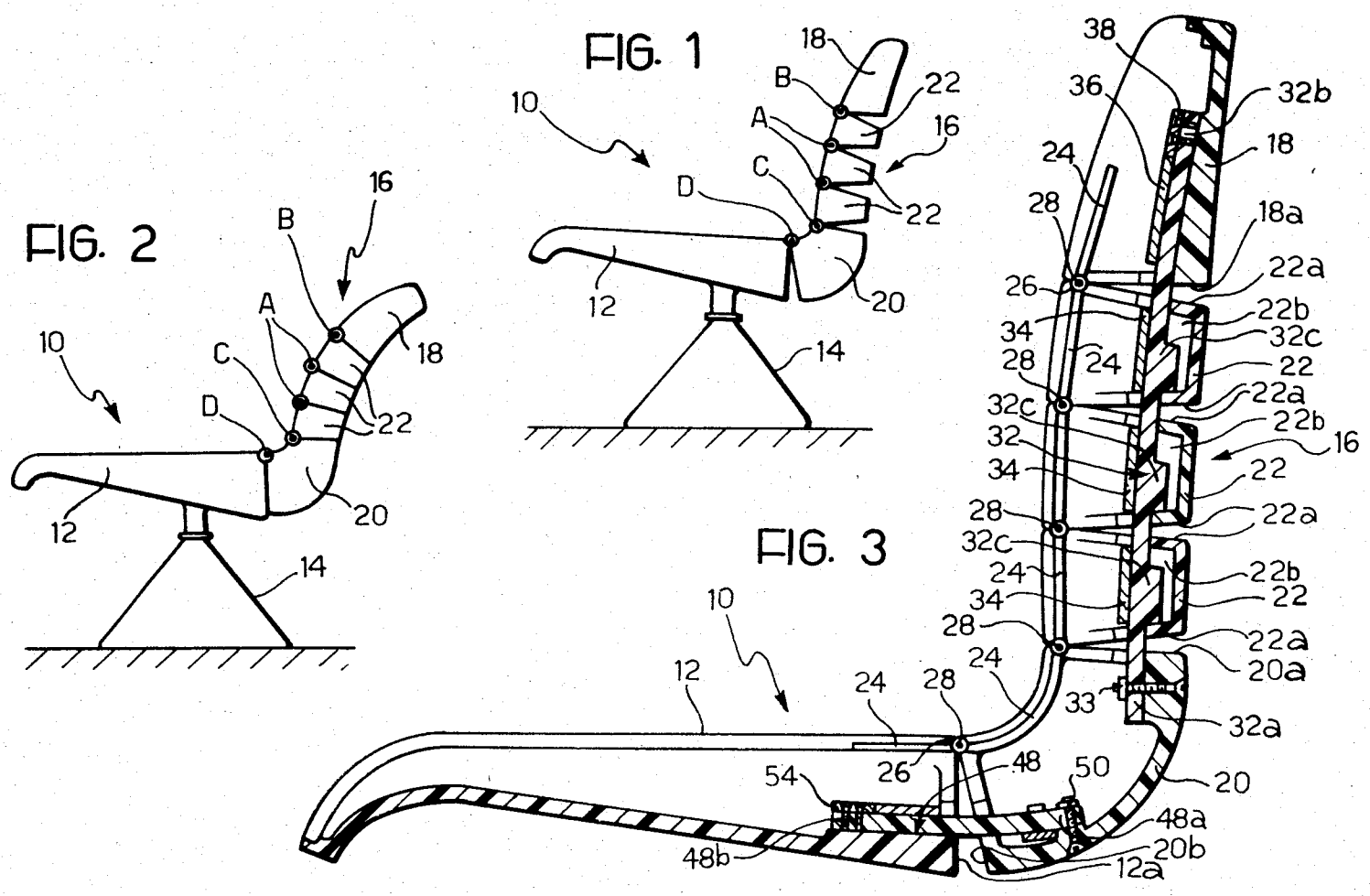

10
12
14
16
18
20
22
A
B
C
D
24
26
28
32
32a
32b
32c
33
34
36
38
48
48a
48b
50
54
12a
20a
20b
22a
22b

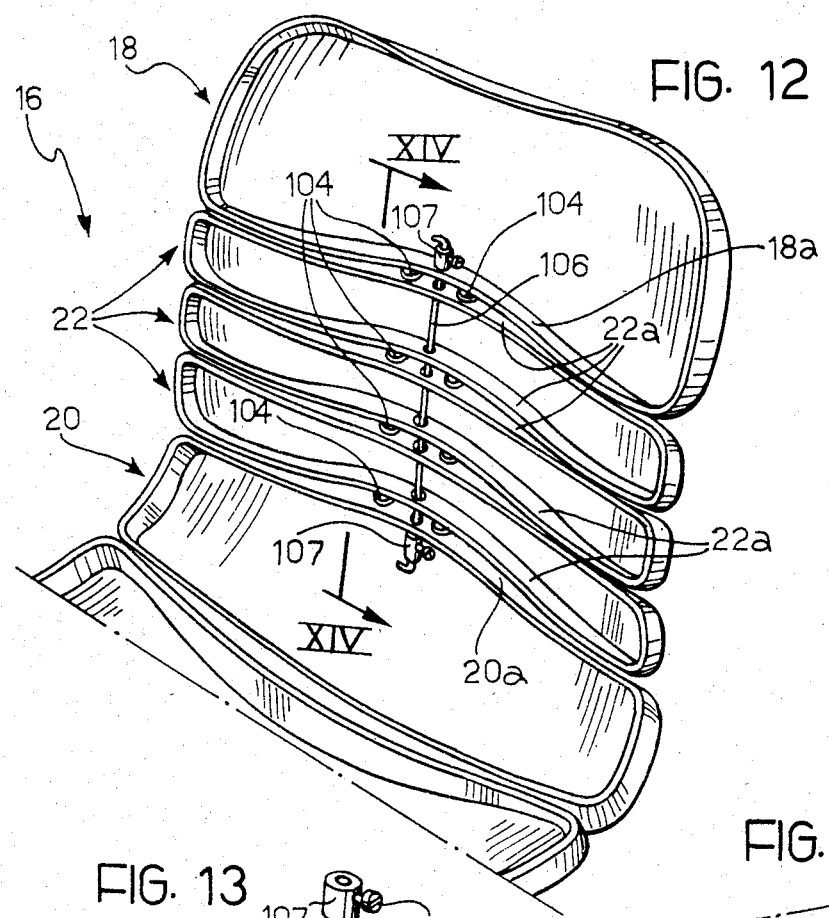
FIG. 12
FIG. 13
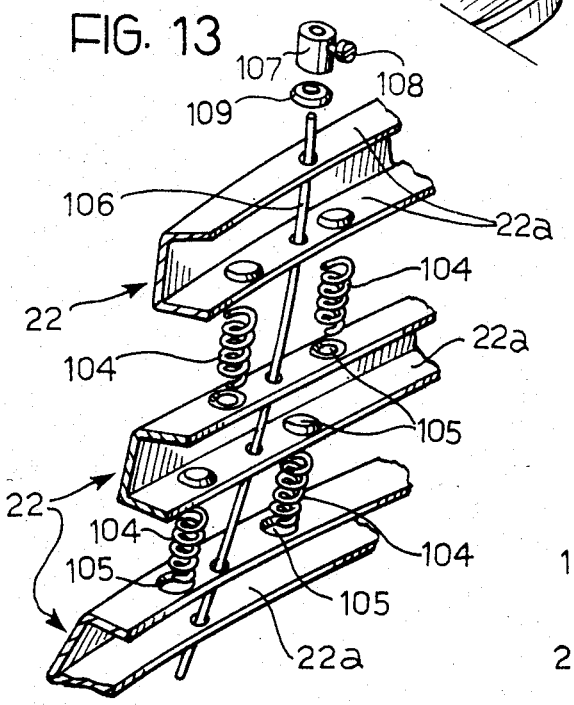
FIG. 14
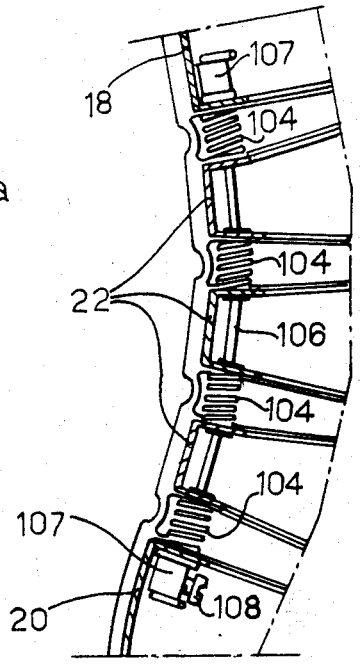

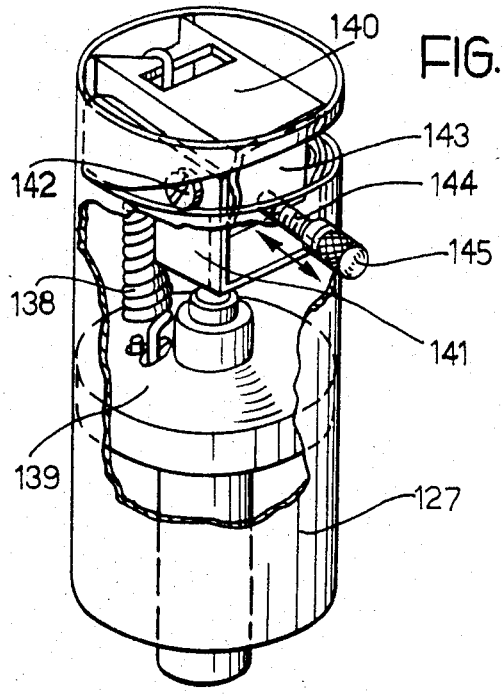
FIG. 21
FIG. 22
FIG. 23
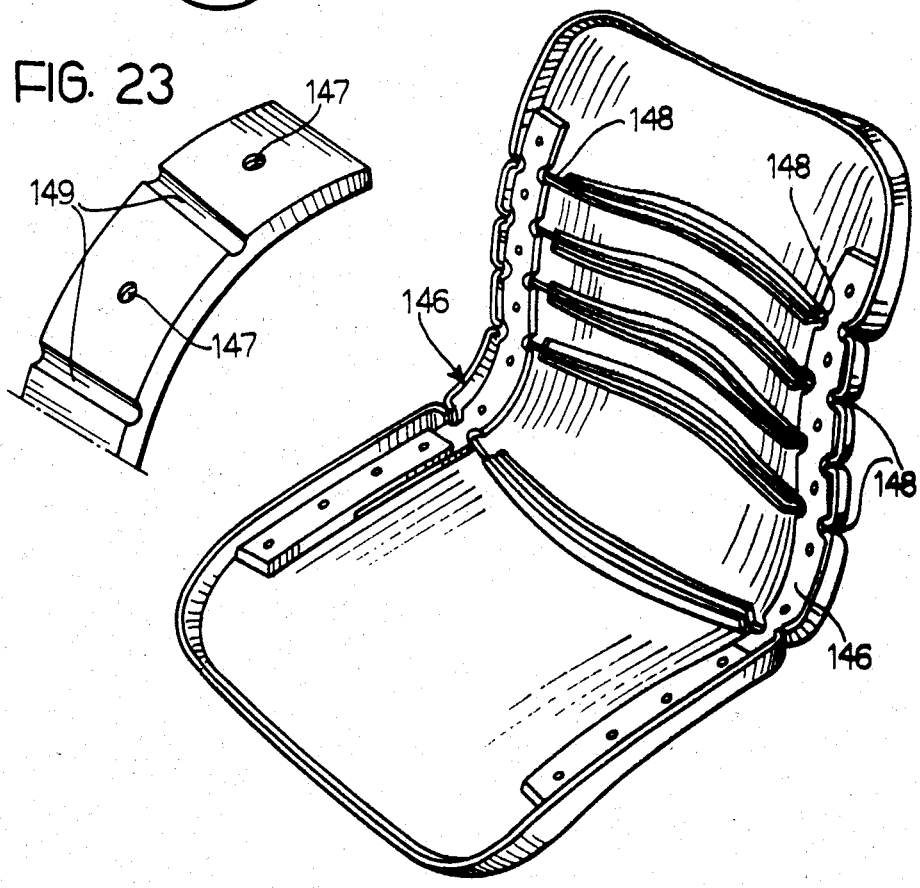

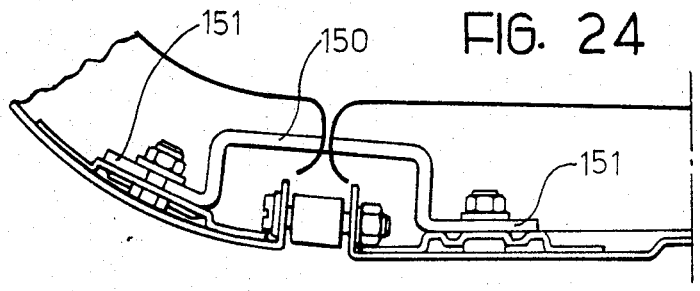
FIG. 24
FIG. 25
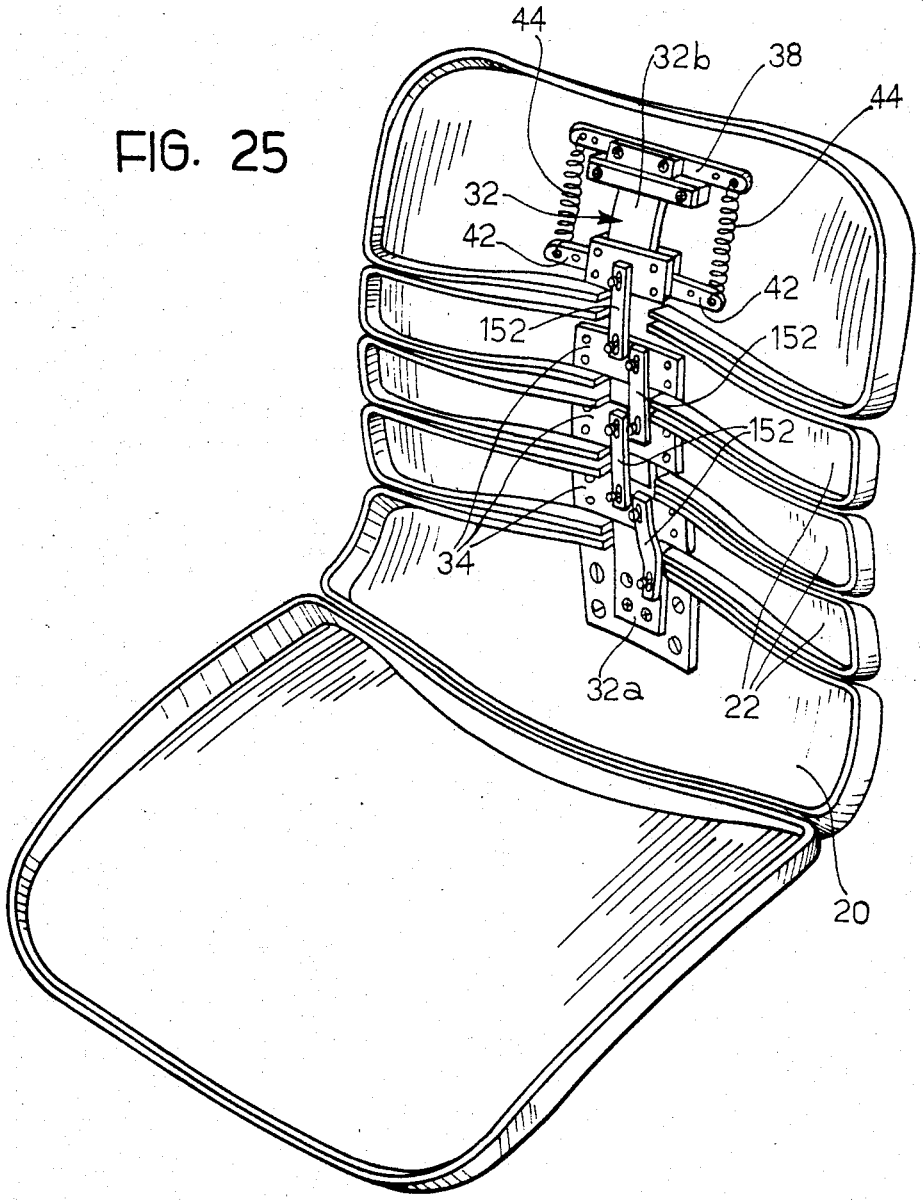

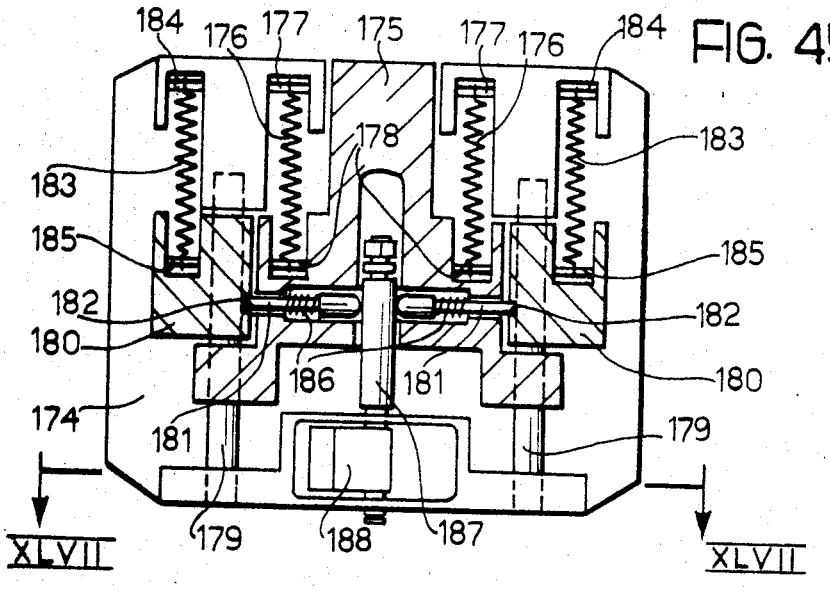
FIG. 45
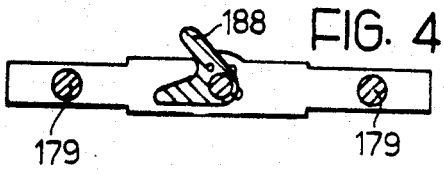
FIG. 47
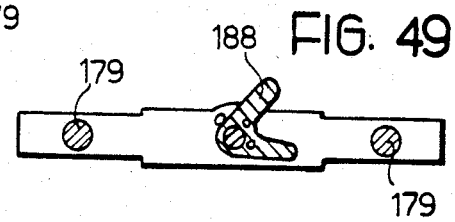
FIG. 49
FIG. 51
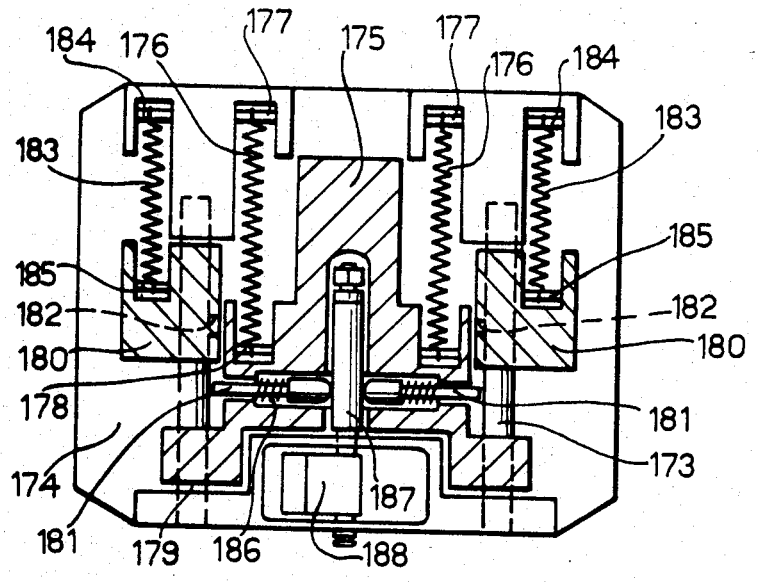

CHAIR HAVING A BACK COMPRISING A PLURALITY OF ARTICULATED SEGMENTS

The present invention relates to chairs having a seat and a backrest which, from an erect position relative to the seat, can take up a partially reclined position corresponding to the resting of a user's back in a relaxed condition.

Chairs of this type are known, in which the backrest is formed by a single element connected to the seat so as to be pivotable between the erect position and the partially reclined position, and in which the backrest is constituted by two parts of which the lower part is connected rigidly or is articulated to the seat and the upper part is pivotable relative to the lower part.

The degree of comfort which can be achieved with such known chairs in the reclined position of the backrest may not be wholly satisfactory. Indeed, in the first case the position assumed by the chair with the backrest reclined necessitates the user's spine being kept substantially straight, which may not favour effective rest. On the other hand, in the second case the support offered by the reclined backrest has a discontinuous configuration with the disadvantage that the position assumed by the user's spine may be unnatural and hence uncomfortable.

In both cases, the constructional form of the backrest and its articulation to the chair have the disadvantage of being relatively complicated and hence expensive.

The object of the present invention is to overcome these disadvantages by forming a chair of the type defined initially, in which the backrest is able to define, in its partially reclined position, a curved support surface the radius of curvature of which follows that of the user's spine in an arched position of maximum relaxation.

Another object of the invention is to provide a chair of the type specified above which is particularly strong and practical and which can be manufactured in a relatively simple and economical manner.

A further object of the invention is to provide a chair in which the backrest may be changed from the erect condition to the reclined position and vice versa by the user's back in a smooth and gradual manner.

In order to achieve these and other objects, the present invention provides a chair of the type defined above, the main characteristic of which lies in the fact that the backrest is formed by a series of at least three superimposed portions or segments which are connected together in an articulated manner about respective, substantially horizontal axes and are used to define, in the said partially reclined position of the backrest, an arcuate configuration with a curve substantially corresponding to that of the arched back of the user, and in that resilient means are provided for resisting the movement of the segments towards the position corresponding to the reclined position of the backrest.

Preferably, there are at least five segments in the series, of which a lower segment for connection to the seat is articulated to the seat itself about a horizontal axis located at a level corresponding to that of the sitting plane of the seat.

According to a further aspect of the invention, the resilient means are distinct and separate from articulated connections between the segments of the backrest. Preferably, these articulated connections are located at the ends of the segments of the backrest and the resilient means are located in correspondence with intermediate zones of the segments.

According to a further preferred embodiment of the invention, the resilient means include flexible blade elements extending transverse the segments of said series and helical springs for returning the flexible blade elements towards their undeformed rest position corresponding to the erect position of the backrest.

Figure 4:
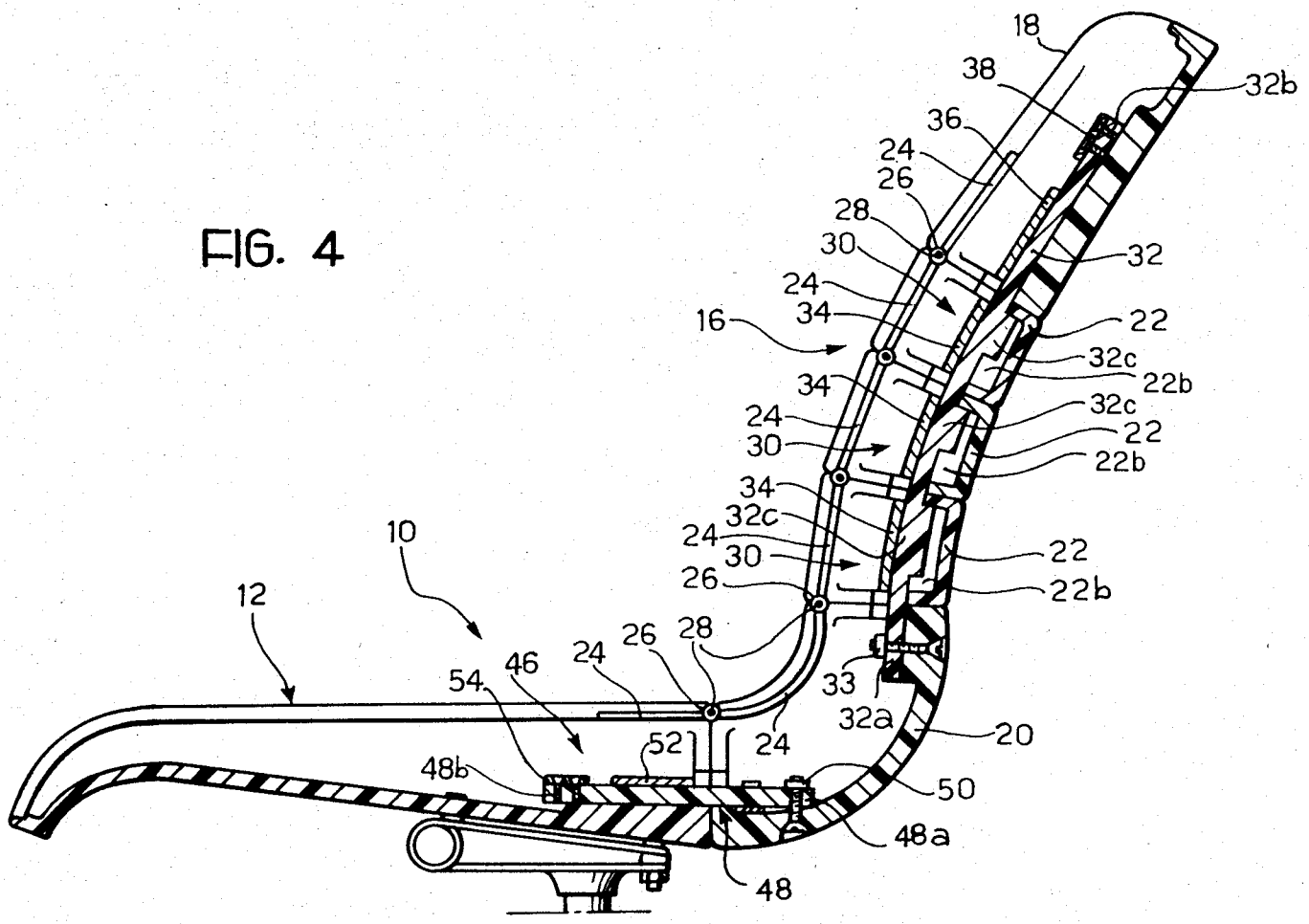
Figure 6:
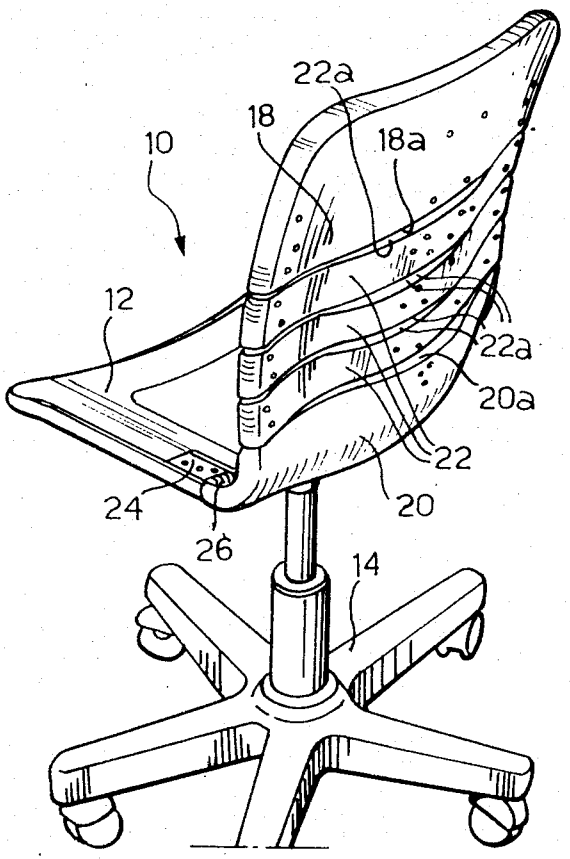
Figure 5:
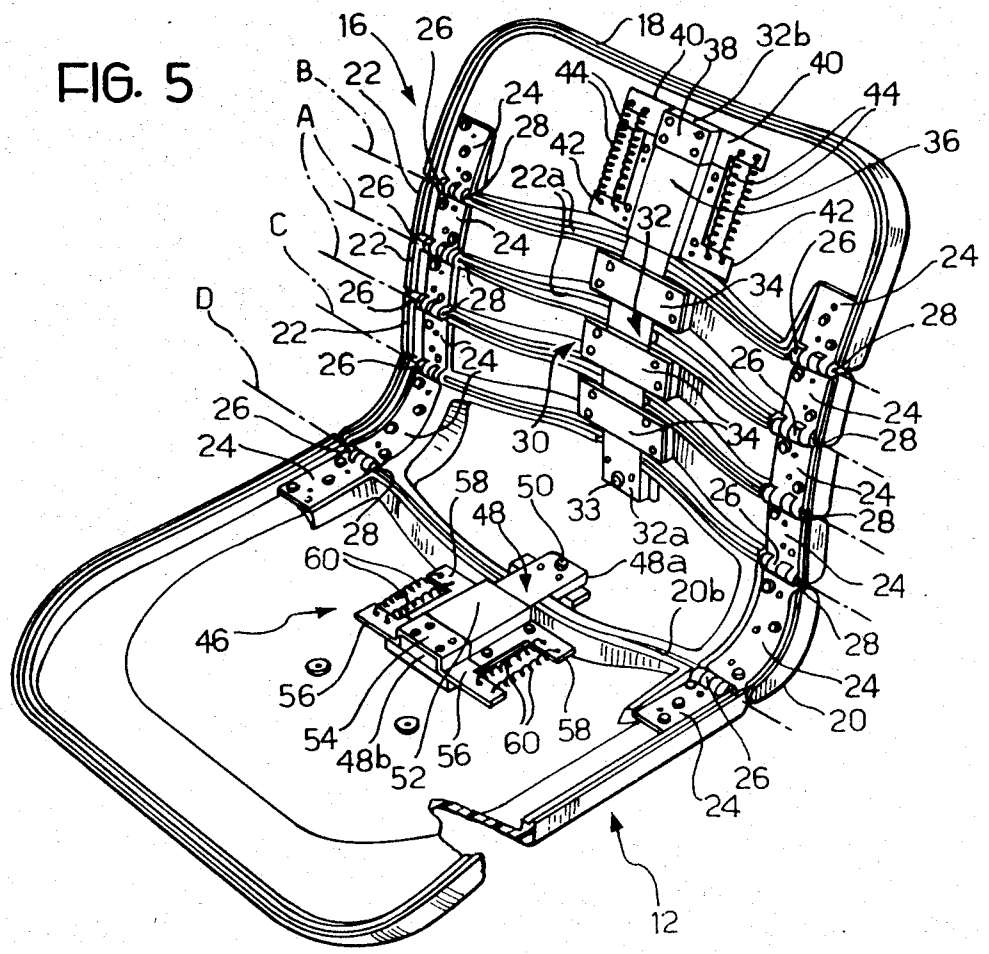
Figure 7:
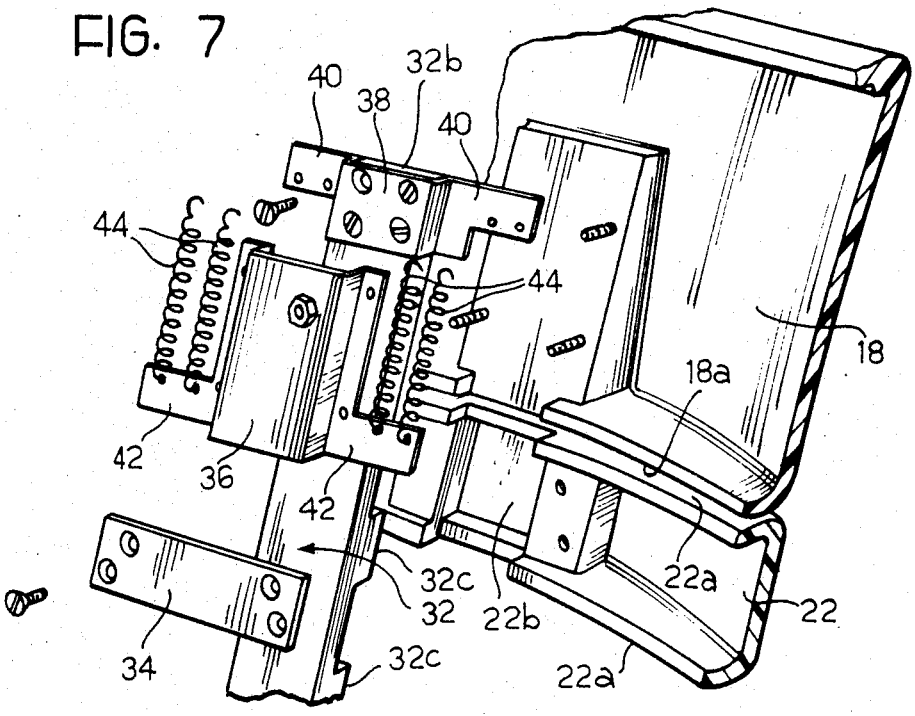
Figure 8:
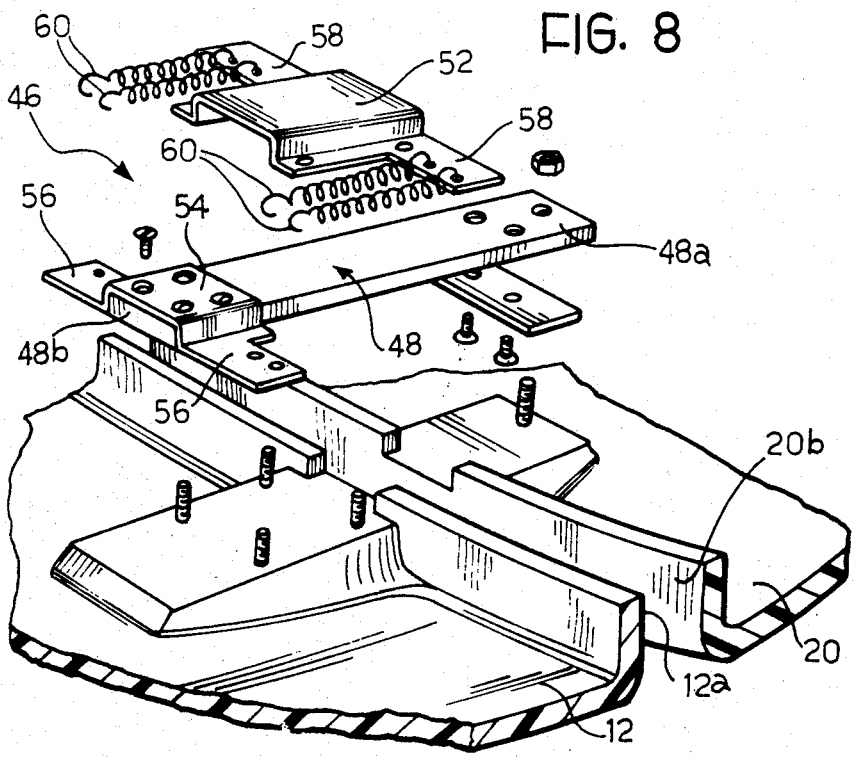
Figure 9:
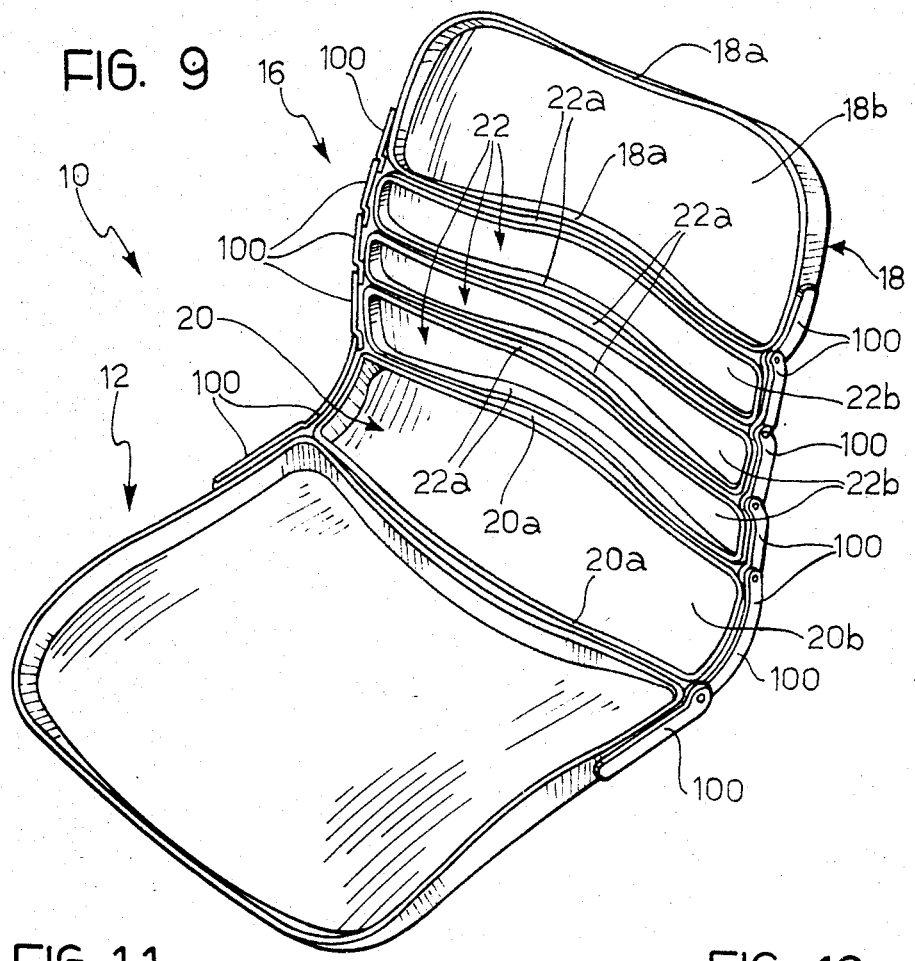
Figure 11:
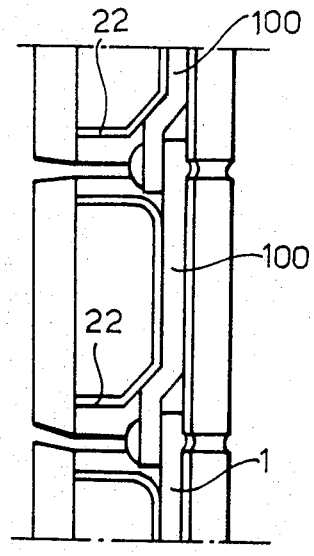
Figure 10:
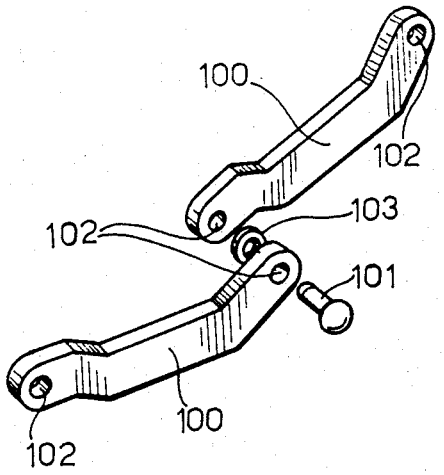
Figure 15:
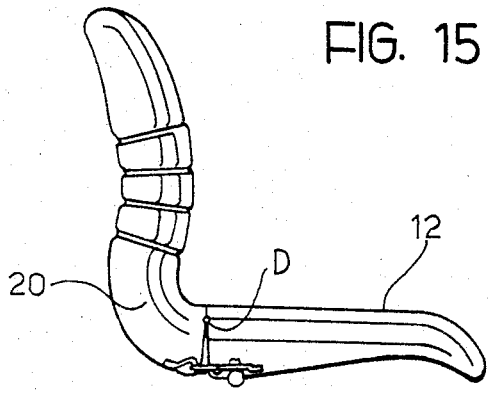
Figure 16:
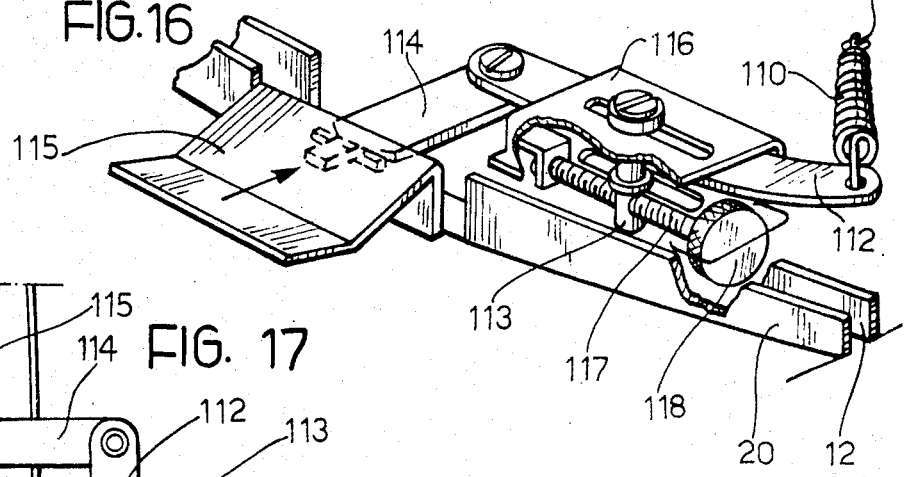
Figure 17:
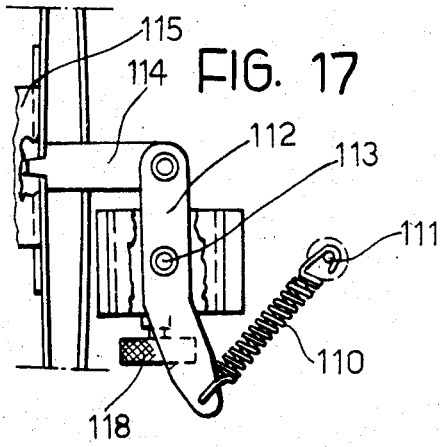
Figure 18:
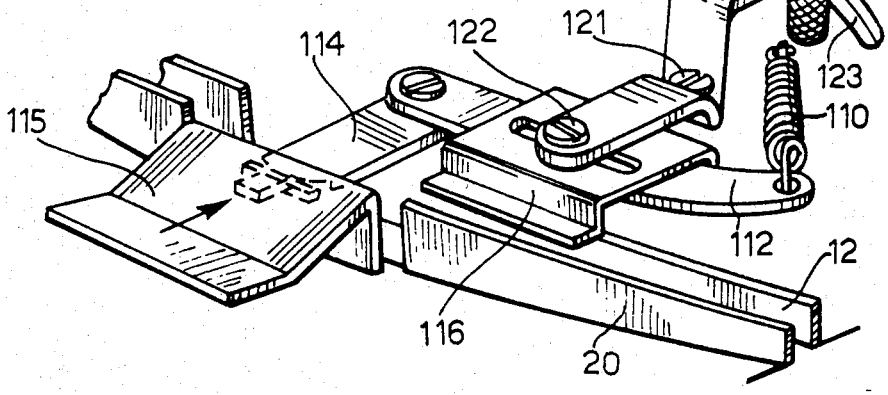
Figure 20:
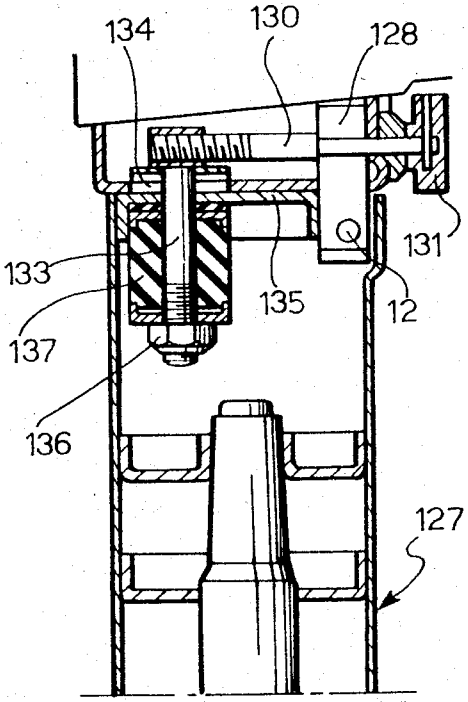
Figure 19:
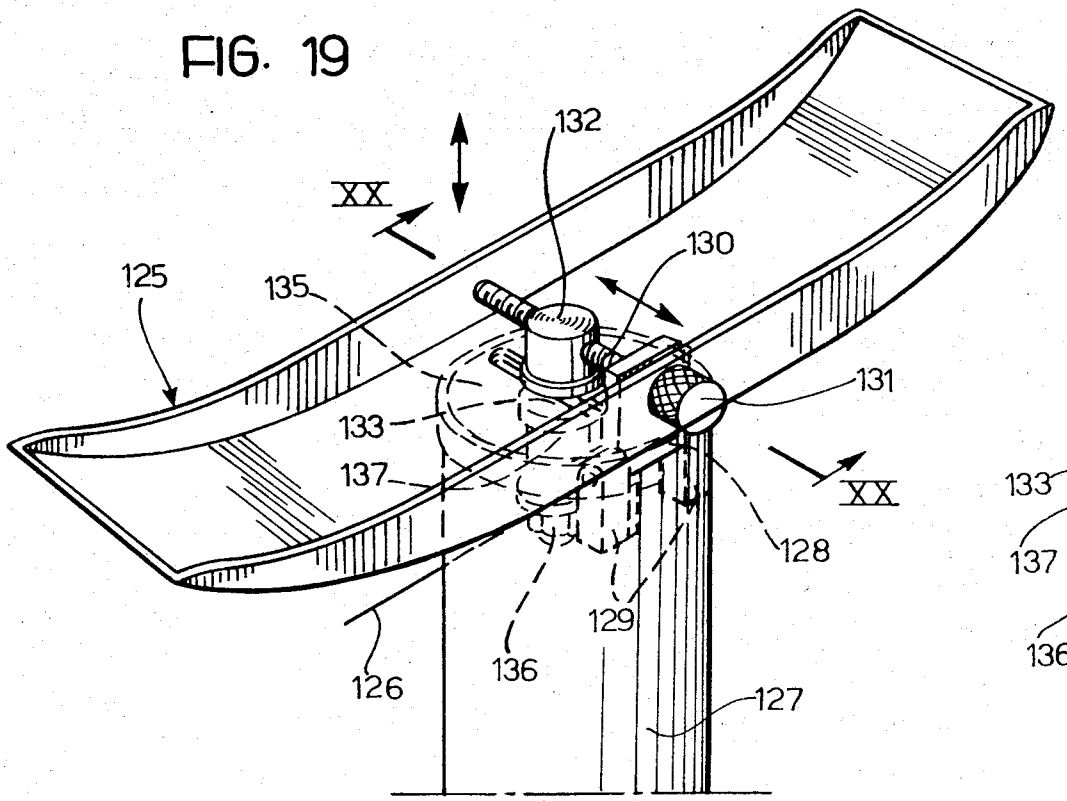
Figure 26:
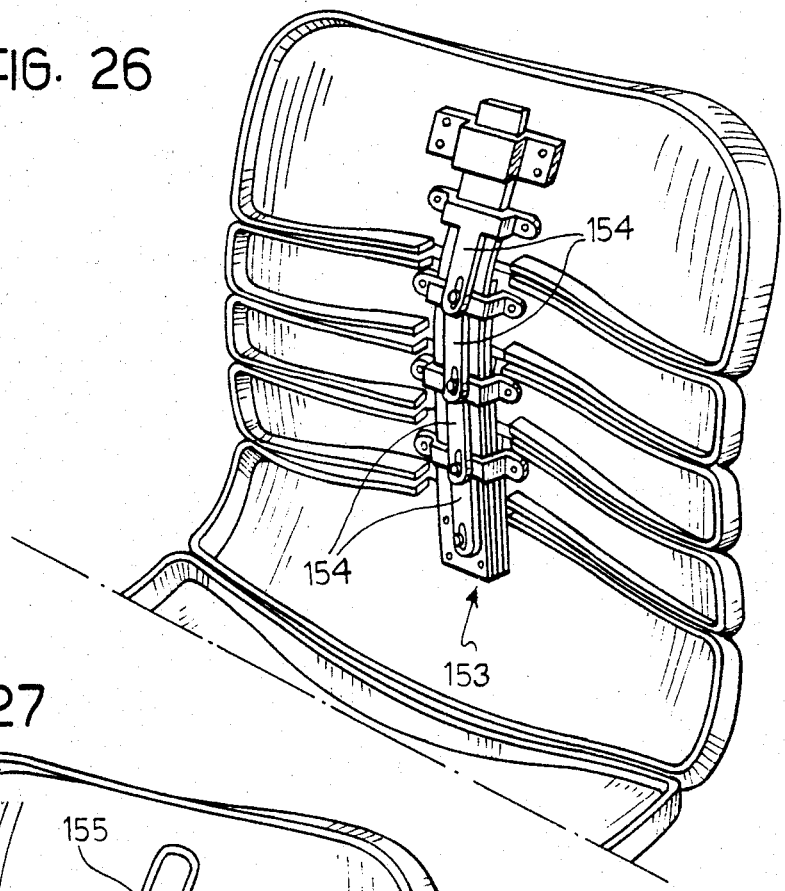
Figure 27:
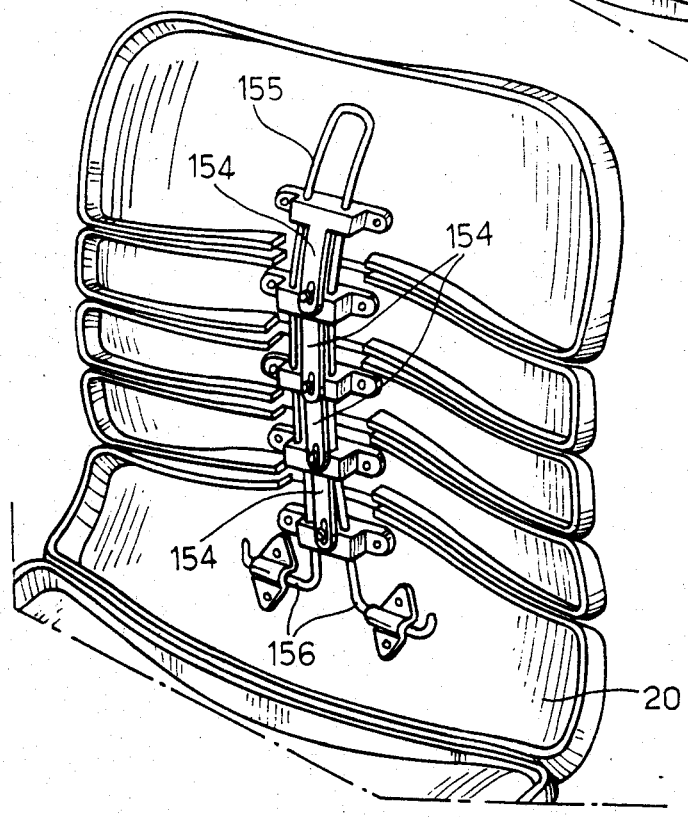
Figure 28:
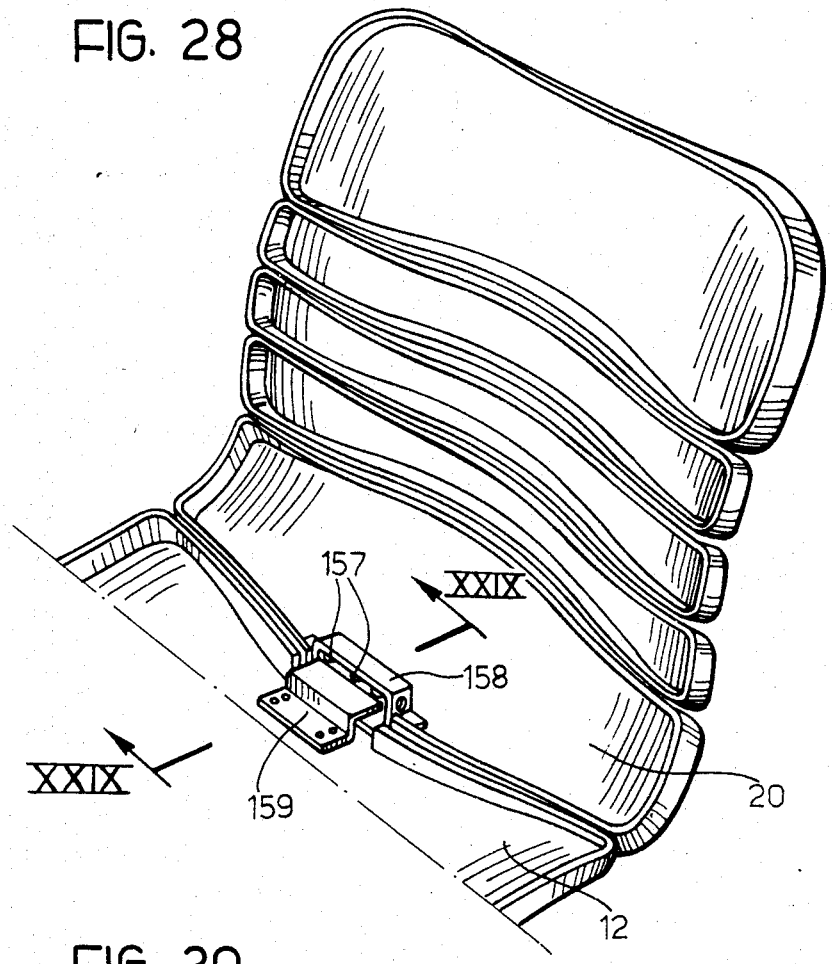
Figure 30:
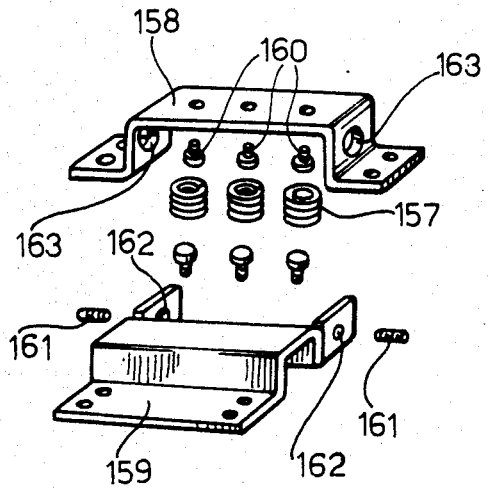
Figure 29:
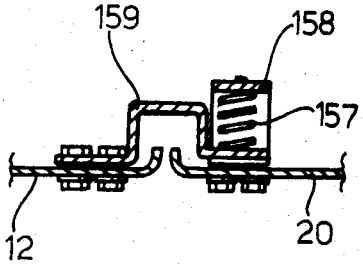
Figure 31:
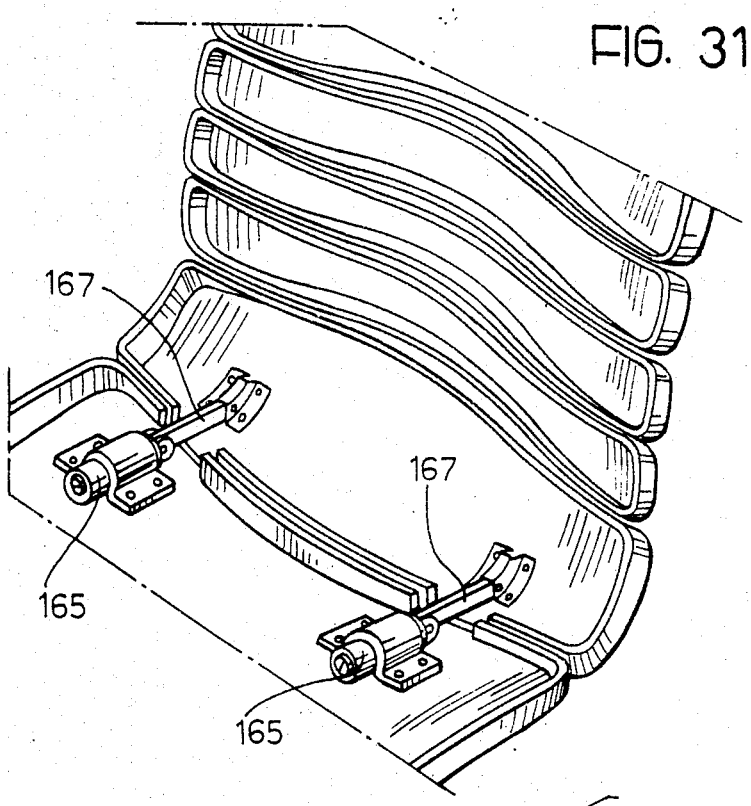
Figure 32:
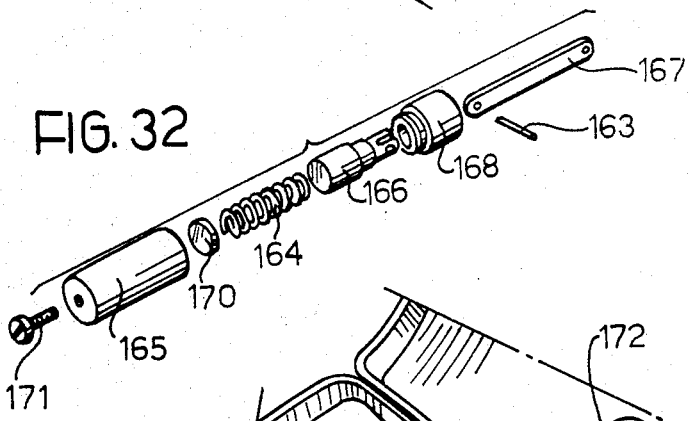
Figure 33:
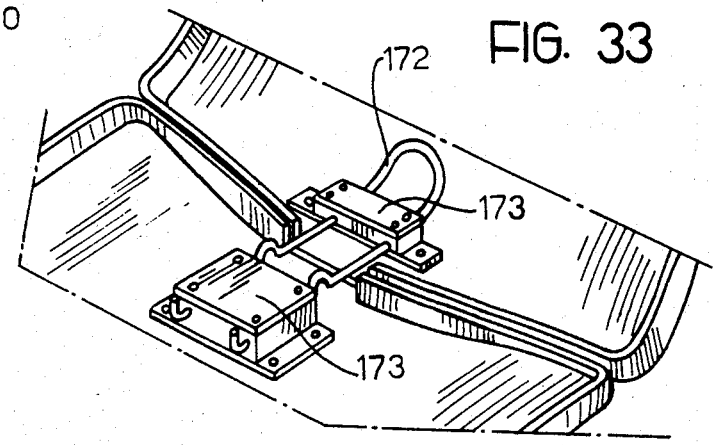
Figure 34:
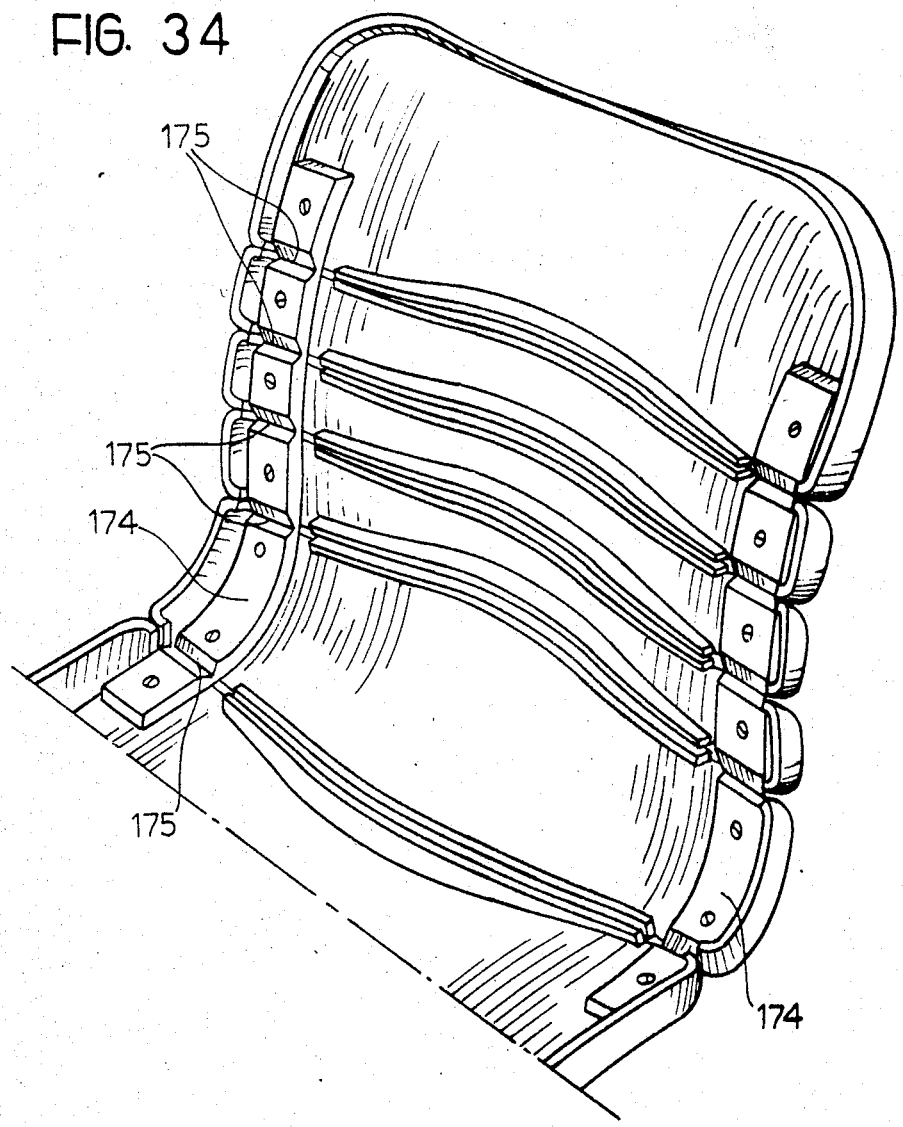
Figure 35:
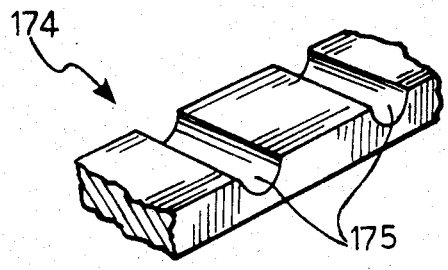
Figure 36:
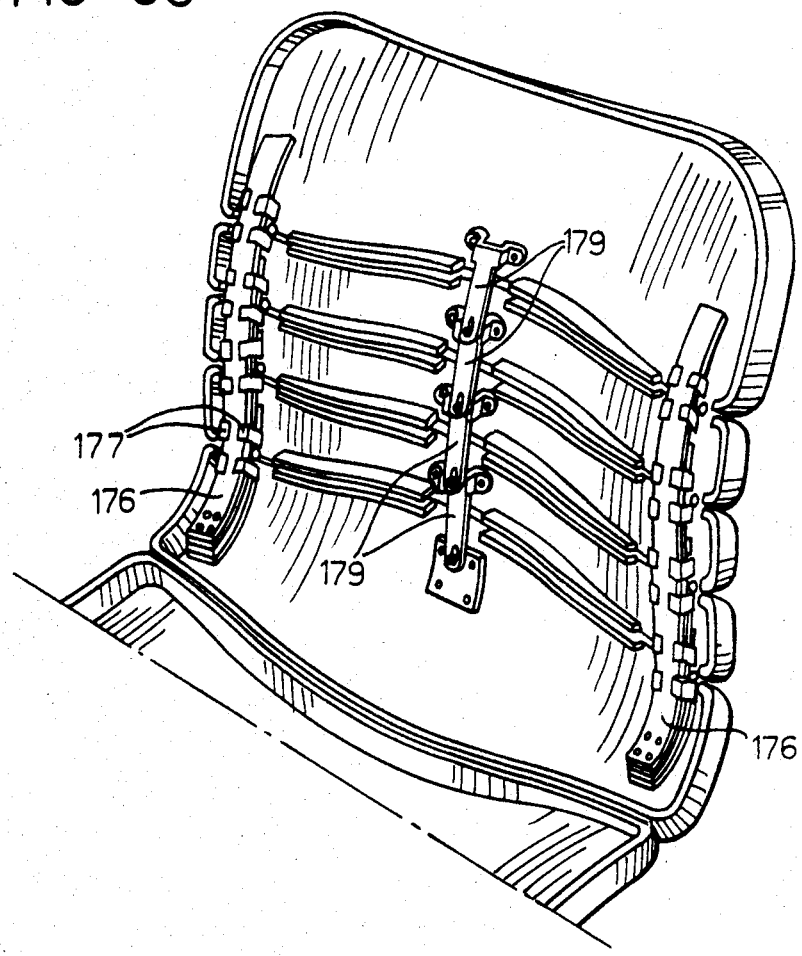
Figure 37:
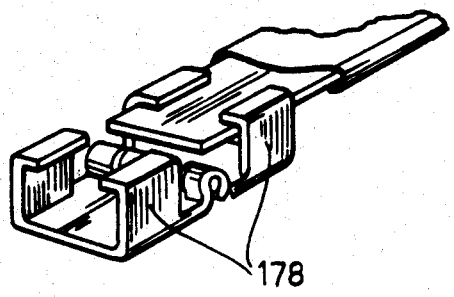
Figure 38:
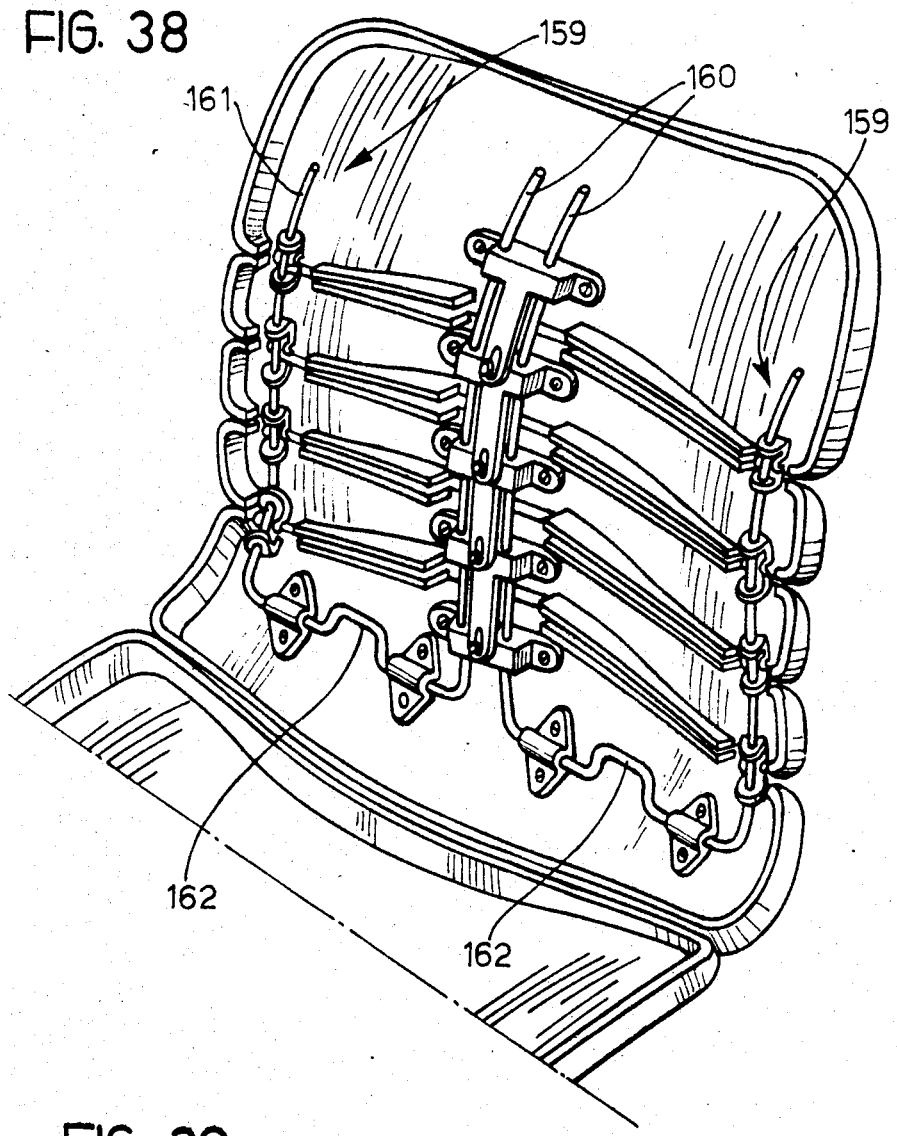
Figure 39:
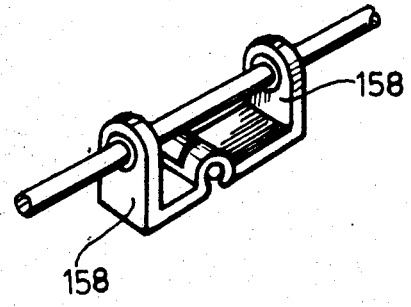
Figure 40:
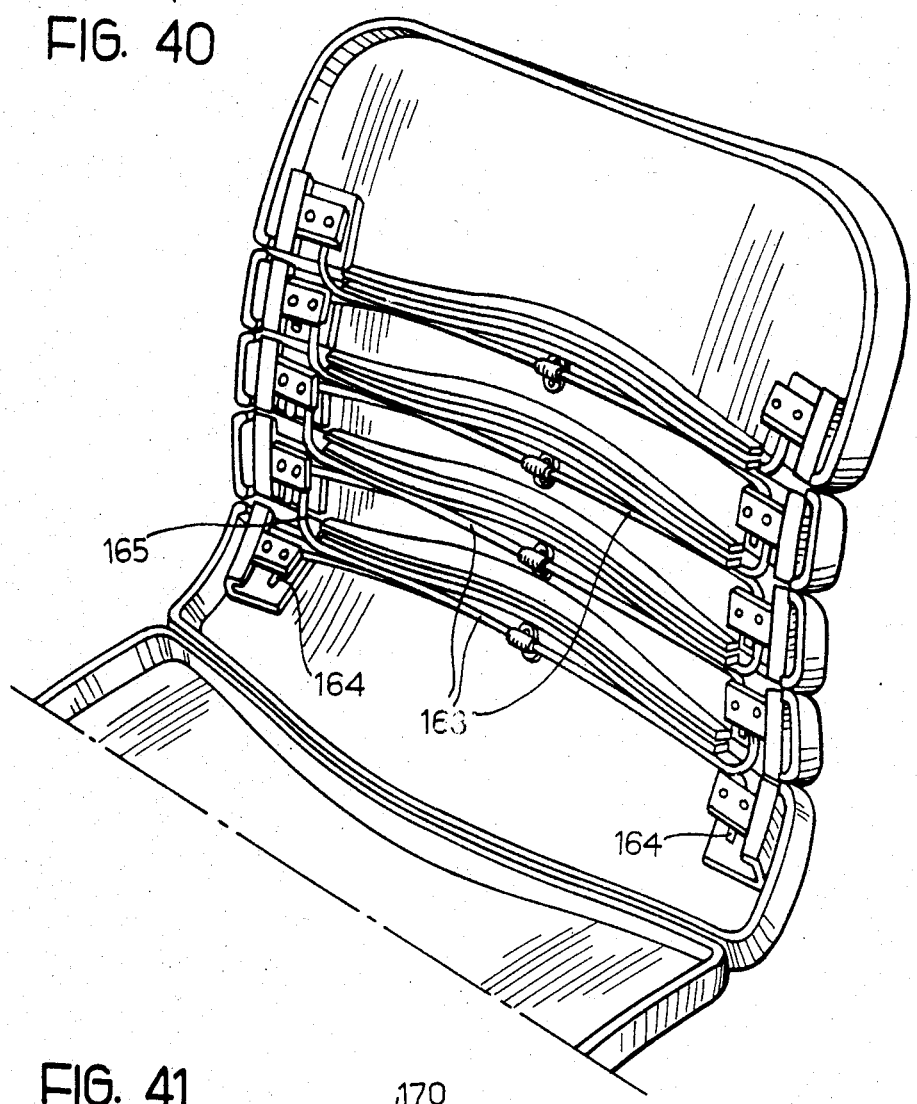
Figure 41:
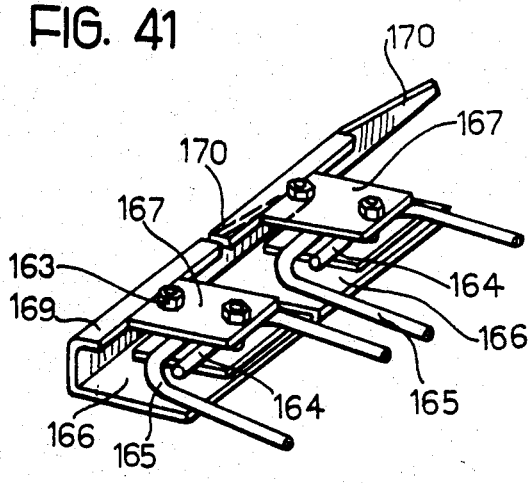
Figure 42:
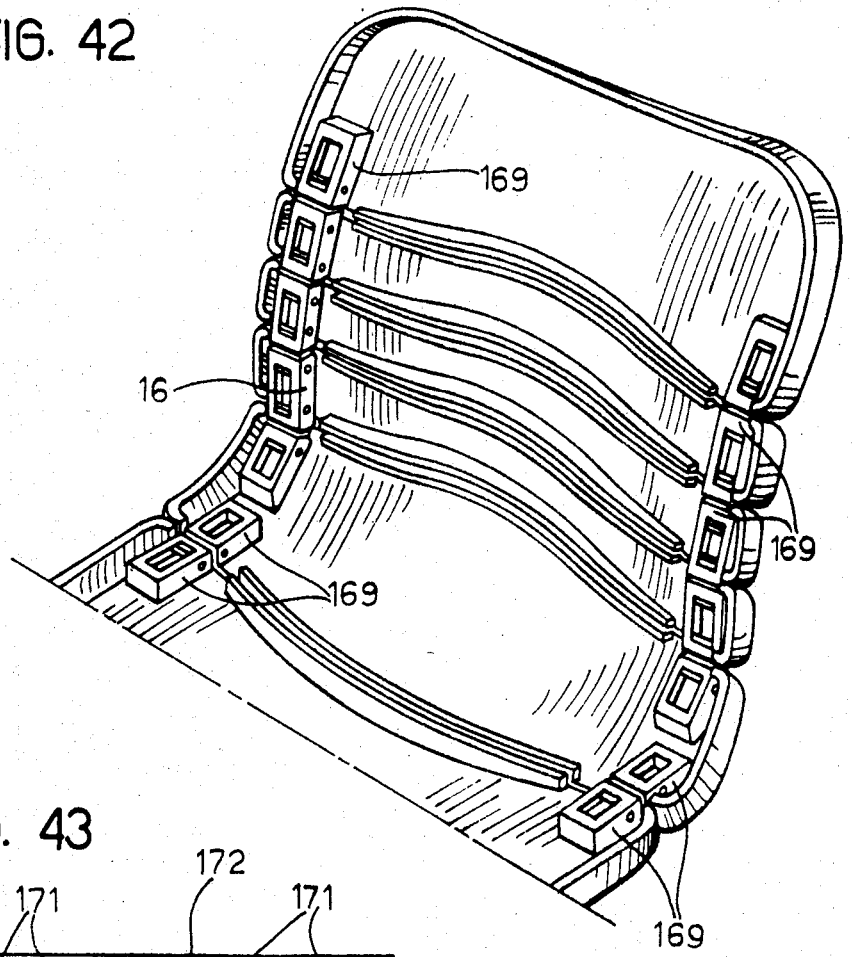
Figure 43:
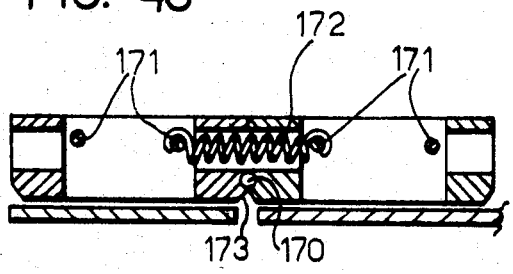
Figure 44:
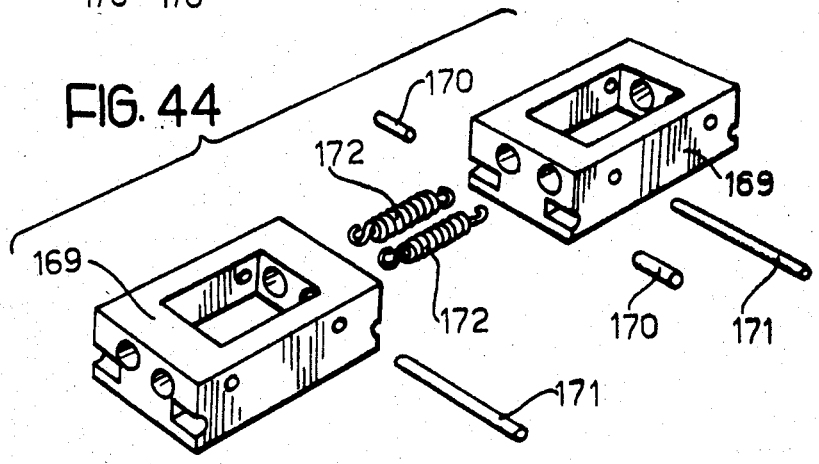
Figure 46:
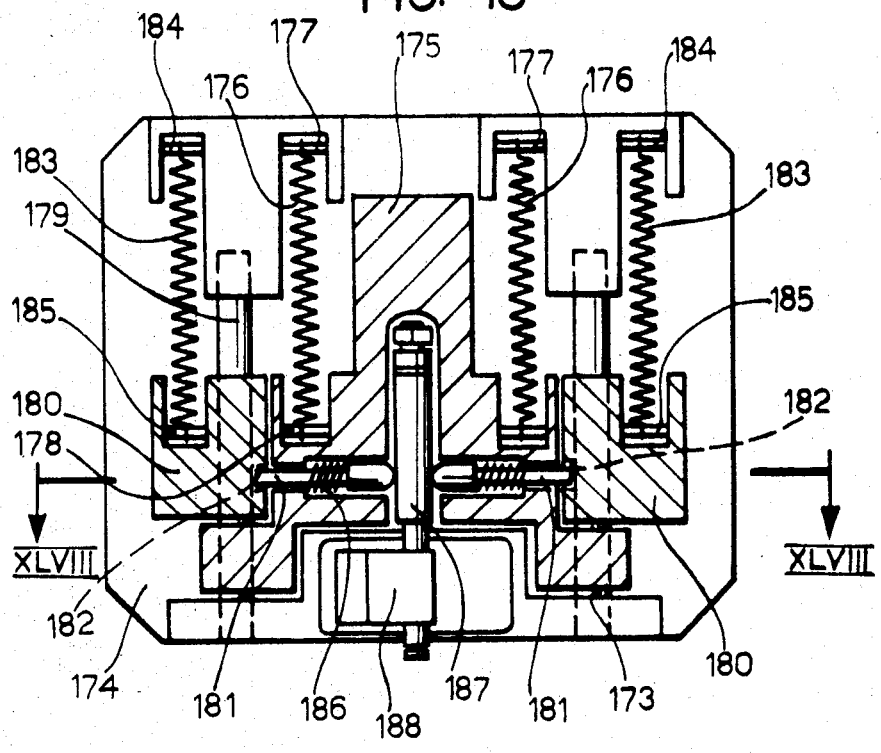
Figure 48:
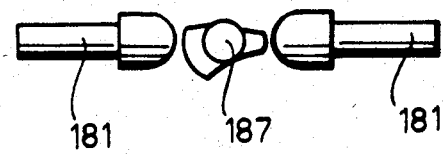

The present invention will now be described with reference to the appended drawings, provided purely by way of nonlimiting example, in which:

FIG. 1 is a schematic side elevational view of a chair according to the invention with its backrest in the erect position, FIG. 2 is a view similar to FIG. 1 with the backrest of the chair in a partially reclined position, FIG. 3 is a vertical sectional view of FIG. 1 on an enlarged scale, FIG. 4 a vertical sectional view of FIG. 2 on an enlarged scale,, FIG. 5 is a frontal perspective view of the structure of the chair, FIG. 6 is a rear perspective view of a structure of the chair, FIGS. 7 and 8 are two exploded perspective views on an enlarged scale, illustrating two details of the chair, FIG. 9 a schematic perspective view of a variant of the connections articulating the backrest segments of the chair according to the invention, FIG. 10 is an exploded perspective view of a detail of FIG. 9 on an enlarged scale, FIG. 11 is a front view of a detail of FIG. 9 on an enlarged scale, FIG. 12 is a schematic perspective view of a variant of the resilient means for returning the backrest to the erect position, FIG. 13 is an exploded perspective view of a detail of FIG. 12 on an enlarged scale, FIG. 14 is a sectional view taken on the line XIV of FIG. 12, FIG. 15 a schematic side view illustrating the positioning of the means for returning the lower connecting segment of the backrest towards the erect position, FIG. 16 is a schematic perspective view on an enlarged scale of a variant of the return means illustrated in FIG. 15, FIG. 17 is a plan view of the return means of FIG. 16, FIG. 18 is a schematic perspective view illustrating a further variant of the means for returning the lower segment for connecting the backrest to the seat towards the erect position, FIG. 19 is a schematic perspective view illustrating a device for pivoting the seat about a transverse horizontal axis, FIG. 20 is a section taken on the line XX of FIG. 19, FIG. 21 is a schematic perspective view illustrating a further variant of the pivoting device of the seat, FIG. 22 is a schematic perspective view illustrating a further variant of the resilient means for returning the backrest towards the erect position, this solution being used at the same time for forming the connections articulating the various segments of the backrest together, FIG. 23 illustrates a variant of FIG. 22, FIG. 24 is a sectional view illustrating a further variant of the means for returning the lower segment connected to the seat towards the erect position, FIG. 25 is a schematic perspective view illustrating a variant of the means for defining the limit positions of the segments of the backrest, FIG. 26 illustrates a further variant of the resilient means for returning the backrest to the erect position, FIG. 27 is a schematic perspective view illustrating yet a further variant of the resilient return means of the backrest, FIG. 28 is a schematic perspective view illustrating a further variant of the return means for the lower connecting segment, FIG. 29 is a section taken on the line XXVIII of FIG. 28, FIG. 30 is an exploded perspective view of a detail of FIG. 29, FIG. 31 is a schematic perspective view illustrating a further variant of the return means for the lower connecting segment, FIG. 32 is an exploded perspective view of a detail of FIG. 31 of an enlarged scale, FIG. 33 is a schematic perspective view illustrating a further variant of the return means for the lower connecting segment, FIG. 34 is a schematic perspective view illustrating a further variant of the articulated connections between the segments of the backrest, FIG. 35 illustrates a variant of FIG. 34, FIG. 36 a schematic perpsective view illustrating a further variant of the articulated connections between the segments of the backrest, FIG. 37 is a schematic perspective view of a detail of FIG. 36 on an enlarged scale, FIG. 38 is a schematic perspective view illustrating a further variant of the resilient means for returning the backrest to the erect position, FIG. 39 illustrates a perspective view of a detail of FIG. 38 on an enlarged scale, FIG. 40 is a schematic perspective view illustrating a further variant of the resilient return means of the backrest and of the articulated connections of the segments of the backrest, FIG. 41 is a perspective view of a detail of FIG. 40 on an enlarged scale, FIG. 42 is a schematic perspective view illustrating a further variant of the return means of the backrest and of the lower connecting segment, FIG. 43 is a sectional view of a detail of FIG. 41 on an enlarged scale, FIG. 44 is an exploded perspective view of the detail of FIG. 43, FIGS. 45 and 46 illustrate schematically an adjusting device for the resilient return means of the backrest in two different conditions of operation, FIGS. 47 and 48 illustrate schematically sections taken on lines XLVII and XLVIII of FIGS. 45 and 46, FIGS. 49 and 50 correspond to FIGS. 47 and 48 and relates to a different condition of operation, and FIG. 51 illustgrates a further condition of operation of the device of FIGS. 45 and 46.

With reference to the drawings, a chair according to the invention, generally indicated 10, comprises a substantially horizontal seat 12 supported by a base 14, and a backrest, generally indicated 16. It should be noted that, in the drawings, only the support structure of the chair 10 has been illustrated in detail, any padding, coverings and the like not having structural functions being omitted for simplicity.

The backrest 16 is constituted, in the example illustrated, by five portions or segments of which the upper one is indicated 18, the lowermost one 20 and the three intermediate segments 22. In the embodiment illustrated, both the segments 18, 20, 22 of the backrest 16 and the seat 12 are formed by bodies of moulded plastics material. It is clear, however, that the components of the chair 10 could also be formed of different materials.

The segments 18, 20, 22 of the backrest 16 have a generally arcuate form in the median zone of the backrest 16, with the concavity facing inwardly of the chair itself. The three intermediate segments 22 have identical shapes and dimensions, being tapered towards the back of the backrest 16 in cross-section with a profile substantially in the form of an isosceles trapezium which widens inwardly of the chair and has oblique sides defining bearing surfaces 22*a*.

The upper segment 18, the section of which has greater dimensions than those of the intermediate segments 22, has a lower bearing surface 18*a* facing the upper bearing surface 22*a* of the intermediate upper segment 22, while the lower segment 20 has an arcuate form with its concavity facing inwardly of the chair 10 and sides 20*a*, 20*b* defining two bearing surfaces intended to cooperate the first with the lower bearing surface 22*a* of the lower intermediate segment 22 and the other with an abutment surface 12*a* of the seat 12.

The three intermediate segments 22 are articulated together about respective horizontal axes A. Moreover, the upper intermediate segment is articulated to the upper segment 18 about a horizontal axis B parallel to the axes A, and the lower intermediate segment is articulated to the upper edge of the lower segment 20 about a horizontal axis C parallel to the axes A and B. The other edge of the lower segment 20 is articulated to the upper edge of the stop surface 12*a* of the seat 12 about a horizontal axis D parallel to the axes A, B and C. As is clearly shown in the drawings, the axes of articulation A, B, C, D are located on that side of the segments 18, 20, 22 facing inwardly of the chair 10, that is, on the side opposite the back of the backrest 16. As a result, the axis of articulation D is located at a level corresponding to that of the sitting plane of the seat 12.

In effect the articulation described above is achieved by means of plates 24 rigidly fixed to the articulated elements of the chair 10 immediately adjacent the sides thereof and provided with respective hinge eyelets 26 through which pass articulation pins 28. The plates 24 with the eyelets 26 may be made by moulding in a single piece with the respective articulated elements of the chair 10.

A first resilient return member, generally indicated 30, is connected to the backrest 16 and comprises a flexible blade element 32 extending transverse the articulated segments 18, 20, 22 in correspondence with the median zone of these segments on the side facing inwardly of the chair 10. The lower end of the flexible blade 32, indicated 32*a*, is rigidly fixed at 33 to the lower segment 20 close to the upper bearing surface 20*a* of the latter. The flexible blade element 32 is slidably connected to the intermediate segments 22 by means of plate-like guide and retaining members 34, and to the upper segment 18 by means of a channel-shaped guide and retaining member 36. As is more clearly shown in FIG. 7, to the upper end 32*b* of the flexible blade element 32 is rigidly fixed a bracket element 38 having side tabs 40 facing corresponding lower side tabs 42 of the member 36. Two pairs of helical tension springs 44, the function of which will be clarified below, are hooked onto the tabs 40 and 42. The back of the flexible blade element 32 has three projections 32*c* housed with vertical clearance in respective recesses 22*b* formed in the median zones of the three intermediate segments 22.

A second resilient return member, indicated 46, interconnects the lower segment 20 and the seat 12. The member 46 has a structure similar to that of the return member 30 and, as illustrated in greater detail in FIG. 8, comprises a flexible blade element 48 having one end 48*a* rigidly fixed at 50 to the segment 20 close to the front bearing surface 20*b* thereof and its other end 48*b* slidably connected to the seat 12 by means of a channel-shaped guide and retaining member 52. To the end 48*b* of the flexible element 48 is fixed a bracket member 54 having side tabs 56 facing corresponding side tabs 58 of the member 52. Two pairs of helical springs 60, the function of which will be clarified below, are hooked onto the tabs 56 and 58.

The two resilient return members 30, 46 normally bias the backrest 16 into an erect position relative to the seat 12, illustrated in FIGS. 1 and 3. In this position, the two groups of helical springs 44 and 60 pull the respective flexible blades 32 and 48 into undeformed rest conditions with the various bearing surfaces 18*a*, 22*a*, 20*a*, 20*b*, and 12*a* spaced from each other. The projections 32*c* projecting from the back of the flexible blade 32 in this position bear against the lower walls of the recesses 22*b* of the three intermediate segments 22.

When the occupant of the chair pushes against the backrest 16 with his back, the segments 18, 20 and 22 rotate about the respective axes A, B,C and D and bend the two blades 32 and 48 against the action of the respective return springs 44 and 60. Thus, a partially reclined position of the backrest 16, illustrated in FIGS. 2 and 4, is reached, in which the support surface for the user's back against the backrest 16 has an arcuate configuration with a curvature substantially corresponding to that of the arched spine of the user. In this condition, the projections 32*c* of the flexible blade 32 are brought into contact with the upper walls of the recesses 22*b* of the three intermediate segments 22, while the cooperating bearing surfaces 18*a*, 22*a*, 20*a*, 20*b* and 12*a* are adjacent each other. In this position of the backrest 16 the chair 10 ensures the best rest position for the user's back, ensuring an optimum degree of comfort.

Immediately the user ceases to press against the backrest 16 with his back, the return springs 44 and 60 return the respective flexible blades 32 and 48 to their undeformed rest positions, and the articulated segments 18, 20 and 22 readopt the position illustrated in FIGS. 1 and 3.

Clearly, it is possible to adjust and adapt the characteristics of the inclination and return of the backrest 16 to the various requirements of use by varying and/or differentiating the rigidity of the two flexible blades 32 and 48.

In the case of the solution illustrated in FIG. 9, the connections articulating the backrest segments together are constituted by elongate metal plates 100 having their ends articulated together and disposed on the two sides of the backrest. Each metal plate 100 is welded to one end of the (metallic) structure of the corresponding backrest segment, as illustrated in detail in FIG. 11. With reference to this Figure, the lower end of each plate 100 is offset from the general plane of the plate to allow its articulated connection to the underlying plate. As illustrated in FIG. 10, this articulated connection is effected by means of a pin 101 which engages holes 102 at the ends of the plates 100 and which is retained in position by clenching. A metal anti-friction washer 103 is also interposed between the two plates.

FIGS. 12 to 14 illustrate an embodiment of the resilient means for returning the backrest to the erect position, which uses a plurality of helical compression springs 104 interposed in pairs between the facing sides of each pair of adjacent segments of the backrest, close to the central part thereof. The ends of the helical springs 104 are housed in depressions 105 formed in the sides of the segments. The position of maximum reclination cf the backrest is defined by the condition of maximum compression of the helical springs 104, while the erect position is defined by a vertical metal wire 106 which passes freely through the various backrest segments and on the ends of which are mounted two metal bushes 107 locked in position by means of a radial screw 108 and arranged to bear against the sides of the upper segment 18 and the lower segment 20. Between each metal bush 107 and the respective segment is interposed an anti-noise ring 109 of hard rubber or plastics material, which is arranged to avoid direct contact between metal and metal.

FIGS. 15 to 17 illustrate an embodiment of the means for returning the lower connecting segment 20 to the erect position.

The return action is achieved by means of a helical spring 110 having one end 111 connected to the structure of the seat 12 and its opposite end connected to a lever 112. The lever 112 is pivotably mounted on a pin 113 on the seat structure, and is connected at its opposite end to a lever 114 connected, in its turn, to an element 115 movable with the lower connecting segment 20 (see also FIG. 15).

With reference to FIG. 15, when the lower connecting segment 20 is brought towards its partially reclined position by rotation about its axis D of articulation, the element 115 moves in the direction of the seat causing the rotation of the pivoted lever 112 against the action of the spring 110. The return action may be adjusted by varying the position of the pin 113 (which is slidably mounted in a slot formed in the lever 112, in the structure of the seat 12 and in a guide plate 116 fixed to the seat), by means of a screw system 117 operated by a khob 118 projecting downwardly through an aperture 119 in the seat.

The variant illustrated in FIG. 18 differs from the device illustrated in FIGS. 16 and 17 solely in that the displacement of the pin 113 is achieved, instead of by means of the screw system operated by a knob, by means of an auxiliary control lever 120 pivotably mounted, in its turn, at an intermediate zone 121 on the structure of the seat and carrying at one end 122 the pivot pin for the lever 113 and at its opposite end a control knob 123 which projects downwardly through an aperture 124 formed in the structure of the seat. The knob 123 can be screwed onto the respective pin so as to bear against the surface of the seat and keep the lever 120 locked in position.

In FIG. 19, a channel-shaped cross member, indicated 125, supports the structure of the seat and is fixed to the upper end of a column 127 constituting the base structure of the chair. This Figure illustrates a device arranged to allow the pivoting of the cross member 125 and therewith the pivoting of the whole seat, about a horizontal transverse axis indicated 126 in the drawing. The example illustrated relates to a possible forward pivoting of the seat, suitable for work chairs, in order to achieve a more correct posture for activities such as typing or data-processing. Clearly, however, the same principle can be applied to the case of rearward pivoting of the seat for a relaxed posture usually used for a directorial-type chair.

The device illustrated in FIG. 19 has the advantage of being locatable within the support column 127 wherein it differs from devices of known type that are housed between the column and the cross xember, resulting in an increase in bulk in the vertical sense, or within the cross member, with a consequent increase in the bulk of the latter.

To the cross member 125 is fixed a hinge element 128 which is articulated to two parallel, spaced-apart hinge elements 129 fixed within the column 127.

The hinge element 128 carries a screw 130 which projects from the cross member at one end, is provided with an operating knob 131, and is engaged in a screw-threaded hole in a body 132 carried by the upper end of a pin 133 (see also FIG. 20). This screw 130 is horizontal and perpendicular to the axis of articulation 126. The pin 133 is mounted in a slot 134 formed in the base part of the cross member and in a corresponding slot in a plate 135 which closes the upper end of the guide column 127 and is provided at its lower end with a nut 136 (see also FIG. 20). A polyurethane compression spring 137 is disposed between the lower surface of the plate 135 and the nut 136.

When the seat is pivoted forwardly about the axis of articulation 126 (that is, in the clockwise sense with reference to FIG. 20) the pin 133 is raised, thus compressing the spring 137 between the nut 136 and the plate 135. The distance between the pin 133 and the axis 126 of articulation may be varied by operating the knob 131 so as to cause the movement of the pin 133 in the slot 134. Thus, he return action of the seat towards the horizontal position is adjusted.

FIG. 21 illustrates a variant in which the resilient means for returning the seat to the horizontal position are constituted by helical spring 138 interposed between a plate 139 within the column 127 and an element 140 rigid with the cross member (not illustrated in FIG. 21). The element 140 is articulated within a channel element 141 fixed within the column 127 by means of a pin 142 the position of which is adjustable. This pin engages slots formed in the walls of the channel element 141 and in the side walls of the element 140, and is supported by an element 143 slidable within the element 140 and displaceable by means of a screw 144 provided with an operating knob 145 projecting from the column 127. Operation of the screw 144 allows the variation of the distance between the spring 138 and the articulation pin 142 so as to achieve a corresponding adjustment of the return action of the seat towards the horizontal position.

FIG. 22 illustrates the case in which the resilient means for returning the backrest to the erect position are constituted by two leaf springs 146 fixed to the various segments of the backrest and to the seat adjacent the two sides of the chair. For this purpose, the leaves of the leaf springs 146 have threaded holes 147 (see FIG. 23) engageable by fixing screws which can be inserted from the back. The leaves of the leaf springs 146 have notches 148 in their longitudinal edges, which define lower strength sections in correspondence with the axes of articulation of the segments.

FIG. 23 illustrates a variant in which the lower strength sections are defined by notches 149 formed in one face of the leaf of the leaf spring.

This solution may also be adopted in a chair without a metal support structure, in which the leaf springs 146 are embedded in a body moulded in a single piece and constituted by resiliently deformable material (for example, polypropylene).

FIG. 24 illustrates, in section, a further embodiment of the resilient return means for the lower connecting segment, in which the resilient return element is formed by a plate 150 bent into a Ω shape, the limbs 151 of which are fixed to the structure of the lower segment 20 and to the structure of the seat 12, respectively.

FIG. 25 illustrates a device for returning the backrest to the erect position, of the type illustrated in FIGS. 1 to 8. This device includes a flexible blade element 32 extending transverse the articulated segments 18, 20 and 22 in correspondence with the median zone of the segments. The lower end of the flexible blade 32, indicated 32*a*, is rigidly fixed to the lower segment 20. The flexible blade element 32 is also slidably connected to the intermediate segments 22 and to the upper segment 18 by means of plate-like guide and retaining members 34. The upper end 32*b* of the flexible blade element 32 is rigidly fixed to a bracket 38 connected by means of a tension spring 44 to the two tabs 42 fixed to the upper segment 18.

The solution illustrated in FIG. 25 differs from that illustrated in FIGS. 1 to 8 in that the plate-like members 34 are connected together by means of auxiliary plates 152 provided at each end with a slot in which a pin fixed to a respective plate 34 is engaged.

When the occupant of the chair pushes against the backrest 16 with his back, the segments 18,20 and 22 rotate about the respective articulations (not illustrated in FIG. 25) bending the blade 32 and stretching the springs 44. The limit position of the movement of the various segments is defined by the auxiliary plates 152 which also have the function of achieving progressive displacement of the segments of the backrest in succession towards the inclined position.

FIG. 26 illustrates a variant in which the resilient return means are constituted by a single leaf spring 153 located in correspondence with the centre of the backrest and in which auxiliary plates 154 are provided and have the same function as the plates 152 of FIG. 25.

The variant of FIG. 27 differs from that of FIG. 26 solely in that, instead of a leaf spring, the resilient return means are formed by a torsion bar 155 constituted by a metal wire bent into an elongate U-shape and disposed vertically in correspondence with the middle of the backrest, and having its two lower ends, indicated 156, bent outwardly at 90° and connected to the lower segment 20.

FIGS. 28 to 30 illustrate a further embodiment of the resilient return means for the lower connecting segment 20, comprising a plurality of helical compression springs 157 interposed between two plates 158, 159 fixed to the lower connection segment 20 and to the seat 12 respectively. To the plates 158,159 are fixed screws 160 the sole function of which is to keep the springs 157 in position. The plates 158, 159 are also articulated together by means of pins 161 which engage corresponding holes 162 (see FIG. 30), 163 formed in parallel, facing walls of the two plates. The pins 161 are mounted in the holes 163 with considerable clearance, so that their axes do not coincide with the axis of articulation between the seat and the backrest.

FIGS. 31 and 32 illustrate a variant of the solution illustrated in FIGS. 28 to 30, in which the resilient return means are constituted by helical springs or polyurethane compression springs 164 arranged horizontally and perpendicular to the axis of articulation between the seat and the backrest, and disposed within cylindrical housings 165 fixed to the seat. Each spring 164 is interposed between the bottom of the respective cylindrical housing 165 and an element 166 articulated to a rod 167 connected at its opposite end to the lower connecting segment 20. The element 166 is slidably mounted within the cylindrical housing 165 and is retained within the latter by means of a closure element 168 screwed into the open end of the cylindrical housing 165. The pin which articulates the rod 167 to the element 166 is indicated 169. The spring 164 acts against the bottom of the cylindrical housing 165 with the interposition of a disc 170 which is movable axially by means of a screw 171 engaged in a threaded hole formed in the bottom of the housing 165. It is thus possible to adjust the load of the springs 164.

FIG. 33 illustrates a variant of the return device for the lower connecting segment 20, which uses a spring constituted by a metal wire 172 bent so as to define an elongate U lying in a horizontal plane perpendicular to the axis of articulation of the seat to the backrest. This U-shaped spring is locked adjacent its free end and adjacent its vertex to the seat 12 and to the lower segment 20, respectively, by means of a plate elements 173.

FIG. 34 illustrates a further embodiment of the articulated connections between the backrest segments. In this case, two strips of thermoplastics material 174 are provided, which are fixed to the various segments of the backrest adjacent the two sides thereof and have notches 175 which define sections of lower strength in correspondence with the axes of articulation of the segments. Naturally, it is possible to use a plurality of separate sectors instead of the two continuous strips. The notches 175 illustrated in FIG. 34 have a V-section, but clearly this section may have any form whatsoever.

By way of example, FIG. 35 illustrates notches with a circular section.

FIG. 36 illustrates an embodiment of the chair in which the resilient return means for the backrest are constituted by two leaf springs 176 located adjacent the sides of the backrest and retained by lugs 177 forming part of hinge members 178 fixed to the various segments and constituting the articulated connections for the latter (see FIG. 37). In the median zone of the backrest, auxiliary plates 179 of the safe type as the plate 154 of FIG. 26 are provided.

FIG. 38 illustrates a variant of FIG. 27 in which the resilient return system is constituted by two metal wires 159 bent so as to define to U-shapes side-by-side, having two adjacent vertical limbs 160 in the median zone of the backrest and two limbs 161 disposed adjacent the sides of the backrest. The central yokes of the two metal wires 159, indicated 162, are connected to the lower connecting segment 20 about an axis parallel to the axis of articulation between the backrest and the seat. The lateral limbs 161 are retained by the hinge elements 158, as illustrated in detail in FIG. 39. Alternatively, a similar solution to that of FIG. 38 can be achieved with three metal wires: a central wire located as in FIG. 27 and two lateral wires bent into L-shapes.

The variant illustrated in FIGS. 40 and 41 uses a torsion bar arranged to constitute both the resilient means for returning the backrest to the erect position and the articulated connections between the various segments of the backrest. The intermediate segments 22 and the lower segment 20 are each provided with two torsion bars constituted by two metal wires 163 arranged parallel to the axes of articulation of the segments.

One of the two metal wires carried by each segment has two end portions 164,165, one bent downwardly and the other upwardly, fixed to the segment itself and to the immediately overlying segment, respectively. The fixing of the portions 164, 165 is achieved by means of plate elements 166, 167 between which they are clamped with the aid of screws 168 (see FIG. 41).

The plates 166 fixed to the various segments of the backrest have turned-back edges 169 with shaped profiles 170 intended to define the limit positions of the movement of the various segments.

FIGS. 42 to 44 illustrate a further embodiment of the resilient return means and the hinges for the segments of the backrest. In this case, small, centrally-apertured blocks of thermoplastics material 169 are used, these being articulated together by means of pins 170 (see also FIGS. 43 and 44) and provided with transverse pins 179 for the hooking of the ends of tension springs 172.

The seats for the articulation pins 170 are defined by complementary cavities formed in the facing ends of the blocks 169. The erect position of the backrest is defined by the contact between the facing surfaces of the blocks 169, while the rearwardly reclined position is defined by contact between two bevelled edges 173 (see FIG. 43) formed on these facing surfaces.

FIGS. 45 to 51 illustrate a resilient return device useable instead of the spring device 44 illustrated in FIG. 25. This device, which may also be used for returning the lower segment connected to the seat to the erect position, comprises a fixed plate 174 and a movable member 175 slidable on this plate. Tension springs, indicated 176, are interposed between pins 177 carried by the plate 174 and pins 178 carried by the slidable element 175. This latter is slidable on cylindrical guides 179 rigid with the plate 174. On these cylindrical guides 179 are also slidably mounted two auxiliary elements 180 which may be made rigid with the movable element 175 by means of two transverse pins 181 slidably mounted in the movable element 175 and arranged to engage seats 182 in the auxiliary elements 180. Two further tension springs, indicated 183, are interposed between pins 184 carried by the plate 174 and respective pins 185 carried by the auxiliary elements 180. Springs 186 bias the springs 181 into positions in which they are disengaged from the respective seats 182 in the auxiliary elements 180. Outward movement of the pins is achieved by means of a shaft 187 with a cam profile, which is rotatably mounted on the plate 174 and provided with a control lever 188 having three operative positions.

When the control lever 188 is in the position illustrated in FIG. 47, the shaft 187 is in the position illustrated in FIG. 48 and the pins 181 are in their extended positions in which they effect the connection between the movable element 175 and both the auxiliary elements 180. When the backrest is brought into its reclined position, the movable element 175 is moved downwardly relative to the plate 174 (with reference to FIG. 45) until it reaches the condition illustrated in FIG. 46. This movement causes the loading of all four springs 176, 183.

Figure 50:
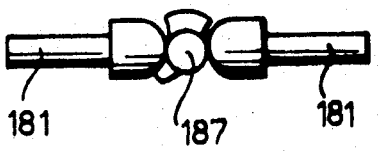

When the control lever 188 is in its position illustrated in FIG. 49, the shaft 187 is in the position illustrated in FIG. 50 whereby the pins 186 are in their retracted positions and the auxiliary elements 180 are not connected to the movable element 175. Hence, movement of the element 175 causes the loading of the springs 176 alone. Under these conditions, therefore, the resilient biasing effect is substantially less than in the preceding case described.

Whenever the lever 188 is disposed in the intermediate position between those illustrated in FIGS. 47 and 49, one of the two pins 186 is in its extended position while the other is in its retracted position, whereby only one of the two auxiliary elements 180 is made rigid with the movable element 175. Under these conditions, therefore, the reclining movement of the backrest causes the loading of both the springs 176 and of only one spring 183. Thus, a biasing action intermediate rhose which occur in the two cases described above is achieved.

The device described above may also be used to lock the backrest in the reclined position. For this purpose, it is necessary to place the control lever 188 in the position illustrated in FIG. 49 initially after reclining of the backrest, the control lever 188 is brought into the position illustrated in FIG. 47, which causes the pins 186 to move outwardly (see FIG. 51) and prevent the return of the movable element 175 into its rest position against the auxiliary elements 180.

I claim:

1. A chair comprising a seat, a backrest connected to said seat for movement between an erect position and a partially reclined position relative to said seat, said backrest, being constituted by a series of at least three superimposed segments disposed adjacent to each other, with the lower segment being disposed adjacent to said seat, articulated connections having horizontal axes disposed between each pair of adjacent segments and between said lower segment and said seat with said lower segment being articulated to said seat about a horizontal axis located at a level corresponding to the sitting plane of said seat, and resilient means biasing said segments towards the erect position including first resilient means operatively connected to all of the segments of the backrest and second resilient means independent from the first resilient means connected to the lower segment of the backrest and the seat.

2. A chair according to claim 1, wherein said resilient means are distinct and separated from the articulated connections of the backrest segments.

3. A chair according to claim 2, wherein the articulated connections are disposed at the ends of said segments and the resilient means are located in intermediate zones of said segments.

4. A chair according to claim 3, wherein at least some of the segments have a generally arcuate form defining a concavity facing inwardly of chair and cross-sections with a profile tapered towards the back of the backrest, and said articulated connections are located on the side of the segments opposite the back of the backrest.

5. A chair according to claim 3, wherein the lower segment has a generally rounded form with its concavity facing inwardly of the chair.

6. A chair according to claim 1, wherein said first resilient means include a single flexible blade element which extends transversely to the segments with its lower end connected rigidly to the lowermost segment adjacent that surface of the lowermost segment facing towards the remaining segments of the said series of segments, and resilient members which connect the upper end of the blade element to the upper segment of the series and are arranged to return the blade element towards an undeformed rest position corresponding to the erect position of the backrest.

7. A chair according to claim 6, wherein said resilient return members include a plurality of helical tension springs located parallel to and on opposite sides of the blade element.

8. A chair according to claim 1, wherein said second resilient means include a flexible blade element having one end connected rigidly to said lowermost segment adjacent the end of the lowermost segment facing the seat and its other end slidably connected to the seat, and resilient members which connect said other end of the blade element to the seat and return the blade element towards its undeformed rest position corresponding to the erect position of the backrest.

9. A chair according to claim 8, wherein said resilient return members include a plurality of helical tension springs located parallel to and on opposite sides of the blade element.

10. A chair according to claim 6 wherein the intermediate segments between the upper and lower segments define respective central recesses and the flexible blade element has respective projections which slidably engage the recesses and cooperate with the lower and upper walls thereof to act as stops for the backrest in said erect position and in said partially reclined position, respectively.

11. A chair according to claim 7 wherein the intermediate segments between the upper and lower segments define respective central recesses and the flexible blade element has respective projections which slidably engage the recesses and cooperate with the lower and upper walls thereof to act as stops for the backrest in said erect position and in said partially reclined position, respectively.

12. A chair according to claim 1, wherein the chair includes a metal support structure for the backrest segments, and the articulated connections of the segments are constituted by elongate metal plates which are articulated together at their ends and located on the two sides of the backrest, each elongate metal plate being welded to one end of the metal structure of a corresponding segment of the backrest.

13. A chair according to claim 12, wherein said elongate metal plates are articulated together by means of clenched metal pins and metal anti-friction washers are interposed between the plates.

14. A chair according to claim 1, wherein first resilient means for returning the backrest towards the erect position comprise a plurality of helical compression springs interposed between the facing side surfaces of each pair of adjacent segments close to the central part of the backrest.

15. A chair according to claim 14, wherein the side surfaces of the segments are moulded with depressions for housing the ends of said helical springs.

16. A chair according to claim 14, wherein the maximum reclined position of the backrest is defined by the condition of maximum compression of said helical springs, and wherein a metal wire passes freely through the segments of the backrest and in its vertical condition defines the erect position of the latter, retaining members being provided at the ends of the wire to bear against corresponding surfaces of the upper and lower segments.

17. A chair according to claim 16, wherein the retaining members are adjustable in position.

18. A chair according to claim 17, wherein the retaining members are constituted by bushes and transverse screws for locking the bushes on the wire.

19. A chair according to claim 16, wherein a nonmetallic ring is interposed between each retaining member and the surface of the adjacent segment on which it bears.

20. A chair according to claim 16, wherein said wire is located at the centre of the backrest, and two helical springs are interposed between each pair of adjacent segments and are located on respective sides of the wire.

21. A chair according to claim 1, wherein the lower segment and the seat are interconnected by a transmission, the transmission including a pivoted lever for putting the second resilient means under tension when the lower segment connected to the seat is brought into said reclined position.

22. A chair according to claim 21, wherein the fulcrum of said pivoted lever is adjustable in position.

23. A chair according to claim 22, wherein the fulcrum comprises an articulation pin, the pivoted lever defines a slot in which the pin is movably engaged, and a screw system including a knob is provided for moving the pin in the slot.

24. A chair according to claim 22, wherein the fulcrum comprises an articulation pin, the pivoted lever defines a slot in which the pin is movably engaged, and a lockable auxiliary control lever is provided for moving the pin in the slot.

25. A chair according to claim 1, wherein the chair includes a support column, the seat has a cross member articulated about a horizontal axis to the upper end of the column, resilient means are provided in the column for returning the seat towards a substantially horizontal position, and adjusting means associated with the resilient means to enable the adjustment of the return action of the seat towards the substantially horizontal position.

26. A chair according to claim 25, wherein the resilient means comprise a compression spring located vertically within the column in a position spaced from the axis of articulation of the cross member on the column and said adjusting means arranged to vary the distance between the compression spring and the articulation axis.

27. A chair according to claim 26, wherein the adjusting means are arranged to cause a translational movement the compression spring.

28. A chair according to claim 26, wherein the cross member is articulated to the column about a pin, and the adjusting means are arranged to displace the pin.

29. A chair according to claim 1, wherein the articulated connections between the backrest segments and the resilient means are both constituted by leaf springs fixed to the backrest segments and the seat adjacent the two sides of the chair, said springs having notches defining sections of lower strength in correspondence with the axes of articulation of the segments.

30. A chair according to claim 29, wherein the segments have a metal support structure and the leaf springs are fixed thereto.

31. A chair according to claim 29, wherein the backrest segments and the seat are moulded in one piece from a resiliently deformable material in which the two leaf springs are embedded.

32. A chair according to claim 1, wherein the second resilient means comprise a resilient blade which is substantially Ω-shaped and connected at its ends to the seat and the lower segment.

33. A chair according to claim 1, wherein each pair of adjacent backrest segments is connected by a plate having a vertical slot at at least one end, and a pin carried by the corresponding backrest segment is engaged in the slot.

34. A chair according to claim 1, wherein said first resilient means comprises a leaf spring disposed vertically at the centre of the backrest, the spring being fixed at its lower end to the lower segment and slidably connected to the remaining backrest segments.

35. A chair according to claim 1, said first resilient means comprise a torsion spring constituted by a metal wire bent into an elongate U-shape and disposed vertically in correspondence with the median zone of the backrest and slidably connected to the backrest segments, the free ends of the wire being bent outwardly at 90° and connected to the lower segment.

36. A chair according to claim 1, wherein said second resilient means comprise a plurality of compression springs and two plates fixed respectively to the lower segment and the seat, the springs being interposed vertically between the plates.

37. A chair according to claim 1, wherein said second resilient means comprise at least one helical spring arranged horizontally and perpendicular to the axis of articulation between the seat and the backrest, a member fixed to the seat, and a lever articulated to the lower segment, the spring being interposed between the member and the lever.

38. A chair according to claim 1, wherein said second resilient means comprise a metal wire bent into a U-shape and lying in a horizontal plane perpendicular to the axis of articulation of the seat and the backrest, the wire being connected at its free ends and at the vertex of its U to the seat and the lower backrest segment respectively.

39. A chair according to claim 1, wherein the articulated connections between the segments of the backrest are constituted by two strips of thermoplastics material fixed to the segments adjacent the two sides of the backrest, said strips having notches which define sections of lower strength in correspondence with the axis of articulation of the segments.

40. A chair according to claim 1, wherein the first resilient means comprise two leaf springs disposed adjacent the sides of the backrest and connected at their lower ends to the lower backrest segment, and the articulated connections between the segments comprise hinge elements including lugs which connect the leaf springs to the remaining segments.

41. A chair according to claim 1, wherein said first resilient xeans comprise two torsion springs constituted by respective metal wires bent so as to define two adjacent U-shapes with two adjacent limbs directed vertically in correspondence with the median zone of the backrest, two opposite limbs arranged adjacent the sides of the backrest, and two central arms connecting the limbs of each spring and connected to the lower segment, and wherein the articulated connections between the backrest segments comprise hinge elements including lugs which connect said opposite limbs to the segments.

42. A chair according to claim 1, wherein the first resilient means and the articulated connections between the backrest segments are formed by a plurality of pairs of torsion springs connected to respective segments, each spring of each pair having a central portion parallel to the axis of articulation of the segments and two end portions which are bent downwardly and upwardly respectively and are connected to a respective segment and the immediately overlying segment, respectively.

43. A chair according to claim 1, wherein the articulated connections between the backrest segments comprise a plurality of pairs of thermoplastics blocks which are articulated together and connected to the segments of respective pairs of adjacent segments, and at least one tension spring interposed between the two blocks of each pair.

44. A chair according to claim 1, wherein the resilient means for returning the backrest towards the erect position comprise a plurality of tension springs, and means for adjusting the return action are provided, which are arranged selectively to prevent the operation of some of the tension springs.

* * * * *